US012012962B2

(12) United States Patent
Klassen et al.

(10) Patent No.: US 12,012,962 B2
(45) Date of Patent: Jun. 18, 2024

(54) FLUID TRANSFER DEVICE

(71) Applicant: 1158992 B.C. Ltd., Surrey (CA)

(72) Inventors: James Brent Klassen, Osoyoos (CA); Alexander Korolev, Burnaby (CA); Ira Jason Soltis, Brevard, NC (US); Timothy Davis Burson, New Westminster (CA); Javier Peter Fernandez-Han, Burnaby (CA)

(73) Assignee: 1158992 B.C. Ltd., Surrey (CA)

( * ) Notice: Subject to any disclaimer, the term of this patent is extended or adjusted under 35 U.S.C. 154(b) by 0 days.

(21) Appl. No.: 18/453,234

(22) Filed: Aug. 21, 2023

(65) Prior Publication Data

US 2023/0392593 A1 Dec. 7, 2023

Related U.S. Application Data

(63) Continuation of application No. PCT/IB2022/051501, filed on Feb. 20, 2022.
(Continued)

(51) Int. Cl.
*F04C 2/10* (2006.01)
*F01D 1/02* (2006.01)
(Continued)

(52) U.S. Cl.
CPC ..... *F04C 2/084* (2013.01); *F04C 2/101* (2013.01); *F04C 2/102* (2013.01); *F04C 2240/30* (2013.01)

(58) Field of Classification Search
CPC ..... F04C 2/084; F04C 2/088; F04C 2/101; F04C 2/102; F04C 23/001; F04D 7/045; F04D 29/2288; F04D 29/62; F01C 1/103
See application file for complete search history.

(56) References Cited

U.S. PATENT DOCUMENTS 3,791,778 A 2/1974 Eron
3,810,721 A 5/1974 Eyer
(Continued)

FOREIGN PATENT DOCUMENTS

DE 3417824 A1 11/1985
DE 3737961 A1 5/1989

OTHER PUBLICATIONS

International Search Report and Written Opinion for International Application No. PCT/IB2022/051501, dated May 24, 2022, 11 pages.

*Primary Examiner* — Deming Wan
(74) *Attorney, Agent, or Firm* — Seed IP Law Group LLP

(57) ABSTRACT

A positive displacement gear pump or gear hydraulic motor having at least a first rotor with first rotor teeth and a second rotor with second rotor teeth, the first rotor teeth meshing with the second rotor teeth. First rotor chambers are defined between first rotor teeth and second rotor chambers are defined between the second rotor teeth. As the rotors mesh, the first rotor chambers, second rotor chambers or both become enclosed or substantially enclosed to form what are referred to here as secondary chambers. Pressure variations in a secondary chamber are relieved by internal flow channels in the first rotor, second rotor or both, creating a fluid connection between the first rotor chambers and the second rotor chambers. The first rotor may be an internal gear rotor or both rotors may be external gear rotors.

23 Claims, 24 Drawing Sheets

Related U.S. Application Data

(60) Provisional application No. 63/151,632, filed on Feb. 19, 2021.

(51) Int. Cl.

| | |
|---|---|
| ***F04C 2/08*** | (2006.01) |
| ***F04C 23/00*** | (2006.01) |
| ***F04D 7/04*** | (2006.01) |
| ***F04D 29/22*** | (2006.01) |
| ***F04D 29/62*** | (2006.01) |

(56) References Cited

U.S. PATENT DOCUMENTS

| | | | | |
|---|---|---|---|---|
| 4,801,255 | A | 1/1989 | Wankel | |
| 4,813,853 | A | 3/1989 | Otto et al. | |
| 4,932,850 | A | 6/1990 | Valavaara | |
| 7,472,677 | B2 | 1/2009 | Klassen et al. | |
| 7,695,260 | B2 | 4/2010 | Holtzapple et al. | |
| 7,726,959 | B2 | 6/2010 | Holtzapple et al. | |
| 8,118,579 | B2 | 2/2012 | Klassen | |
| 10,072,656 | B2 * | 9/2018 | Klassen | F04C 2/084 |
| 10,738,615 | B1 | 8/2020 | Klassen | |
| 2017/0122316 | A1 * | 5/2017 | Moetakef | F01M 1/02 |

* cited by examiner

FLUID TRANSFER DEVICE

TECHNICAL FIELD

Gear pumps and gear hydraulic motors.

BACKGROUND

Gear pumps and gear hydraulic motors can form substantially enclosed chambers at parts of their rotation, which may change in volume lead to water hammer and turbulence.

SUMMARY

There is provided a positive displacement fluid transfer device including a housing defining an inlet flow channel and an outlet flow channel, a first rotor and a second rotor. The first rotor is mounted for rotation within the housing about a first rotor axis and having first rotor teeth, and defining at least in part first rotor chambers between the first rotor teeth, each first rotor chamber being defined at least in part by two first rotor teeth of the first rotor teeth. The second rotor is mounted for rotation within the housing about a second rotor axis parallel to the first rotor axis and having second rotor teeth, and defining at least in part second rotor chambers between the second rotor teeth, each second rotor chamber being defined at least in part by two second teeth of the second rotor teeth. The first rotor teeth and the second rotor teeth are configured to mesh together at a meshing portion of the fluid transfer device. The first rotor teeth and the second rotor teeth enter into the meshing at an outlet portion of the device, the meshing of the first rotor teeth and the second rotor teeth reducing the collective volume of the first rotor chambers and the second rotor chambers in the outlet portion of the device, at least the first rotor chambers being open to the outlet flow channel in the outlet portion of the device. The first rotor teeth and the second rotor teeth unmesh at an inlet portion of the device, the unmeshing of the first rotor teeth and the second rotor teeth increasing the collective volume of the first rotor chambers and the second rotor chambers in the inlet portion of the device, at least the first rotor chambers or at least the second rotor chambers being open to the inlet flow channel in the inlet portion of the device. At least one of the first rotor and the second rotor define internal flow channels arranged to connect the first rotor chambers with the second rotor chambers at least in part of the inlet portion, the meshing portion or the outlet portion of the device.

In various embodiments, there may be included any one or more of the following features: one of the first rotor and the second rotor may be an outer rotor and another of the first rotor and the second rotor may be an inner rotor, the teeth of the outer rotor (outer rotor teeth) meshing with the teeth of the inner rotor (inner rotor teeth) as internal gear teeth. There may be a crescent seal between the inner rotor and the outer rotor. The crescent seal may seal against the outer rotor teeth for positive displacement of fluid around the crescent seal in the first rotor chambers, against the inner rotor teeth for positive displacement of fluid around the crescent seal in the second rotor chambers, or both. In cross section in a plane perpendicular to the outer rotor axis, the outer rotor teeth may be shaped as fins including generally straight leading fin surfaces and generally straight trailing fin surfaces, and the inner rotor teeth are shaped as lobes including rounded leading lobe surfaces and rounded trailing lobe surfaces, the leading lobe surfaces being arranged to contact the trailing fin surfaces and the trailing lobe surfaces being arranged to contact the leading fin surfaces. Other planes perpendicular to the outer rotor axis may have the same or different cross section. Here, the leading and trailing directions are defined by the rotation of the rotors, and as the rotors mesh in an internal gear arrangement the direction of rotation of the outer rotor is also that of the inner rotor. The outer rotor fins may number twice the inner rotor lobes. Tn cross section in the plane, the leading and trailing fin surfaces may be straight and the leading and trailing lobe surfaces may be circular arcs. A first fin of the outer rotor fins may have a leading first fin surface of the leading fin surfaces parallel to and displaced in the trailing direction from a first radial line through the outer rotor axis by a first displacement amount, an opposite fin of the outer rotor fins being rotationally symmetric with the first fin of the outer rotor fins, and a first lobe of the inner rotor lobes may have a trailing first lobe surface of the trailing lobe surfaces formed in a trailing arc shape, the trailing arc shape having a trailing arc radius substantially equal to, or equal to less a first clearance value, the first displacement amount. A second fin of the outer rotor fins may have a trailing second fin surface of the trailing fin surfaces parallel to and displaced in the leading direction from a second radial line through the outer rotor axis by a second displacement amount, a second opposite fin of the outer rotor fins being rotationally symmetric with the second fin of the outer rotor fins, and a second lobe of the inner rotor lobes may have a leading second lobe surface of the leading lobe surfaces formed in a leading arc shape, the leading arc shape having a leading arc radius substantially equal to, or equal to less a second clearance value, the second displacement amount. The first displacement amount is equal to the second displacement amount. For example where the above applies with the first lobe being the lobe, the trailing arc shape may be concentric with the leading arc shape, and the leading first fin surface may be parallel to the trailing second fin surface. The outer rotor fins may be rotationally symmetric about the outer rotor and the inner rotor lobes may be rotationally symmetric about the inner rotor.

In other embodiments, the first rotor teeth and the second rotor teeth may mesh as external gear teeth.

In any of these embodiments, the internal flow channels may be within the first rotor teeth, within the second rotor teeth, or both. In an example, the internal flow channels of the first rotor may be within every second first rotor projection with the internal flow channels of the second rotor being within every second second rotor projection. The positive displacement fluid transfer device may be arranged to direct fluid flow throughout the device substantially perpendicular to the first rotor axis. The positive displacement fluid transfer device may be configured to operate as a pump, the inner rotor, outer rotor or both being connected to a mechanical energy source to drive the pump. The positive displacement fluid transfer device may be configured to operate as a hydraulic motor, fluid pressure driving the inner rotor, the inner rotor being connected to a mechanical energy receiver, or fluid pressure driving the outer rotor, the outer rotor being connected to a mechanical energy receiver, or both.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

There are disclosed designs for and a method of designing and constructing a fluid transfer device comprising at least a plurality of rotors, and a housing. The device may be similar in construction to a conventional positive displacement pump, but includes additional features designed to reduce the likelihood of fluid hammer or cavitation which may be undesirable in such devices.

A sealing contact is defined in this disclosure as an area of contact or sealing proximity between two rotors or between a rotor and the housing. Sealing proximity is defined, in this disclosure, as a gap of sufficient flow resistance to prevent undue leakage.

Figure 22:
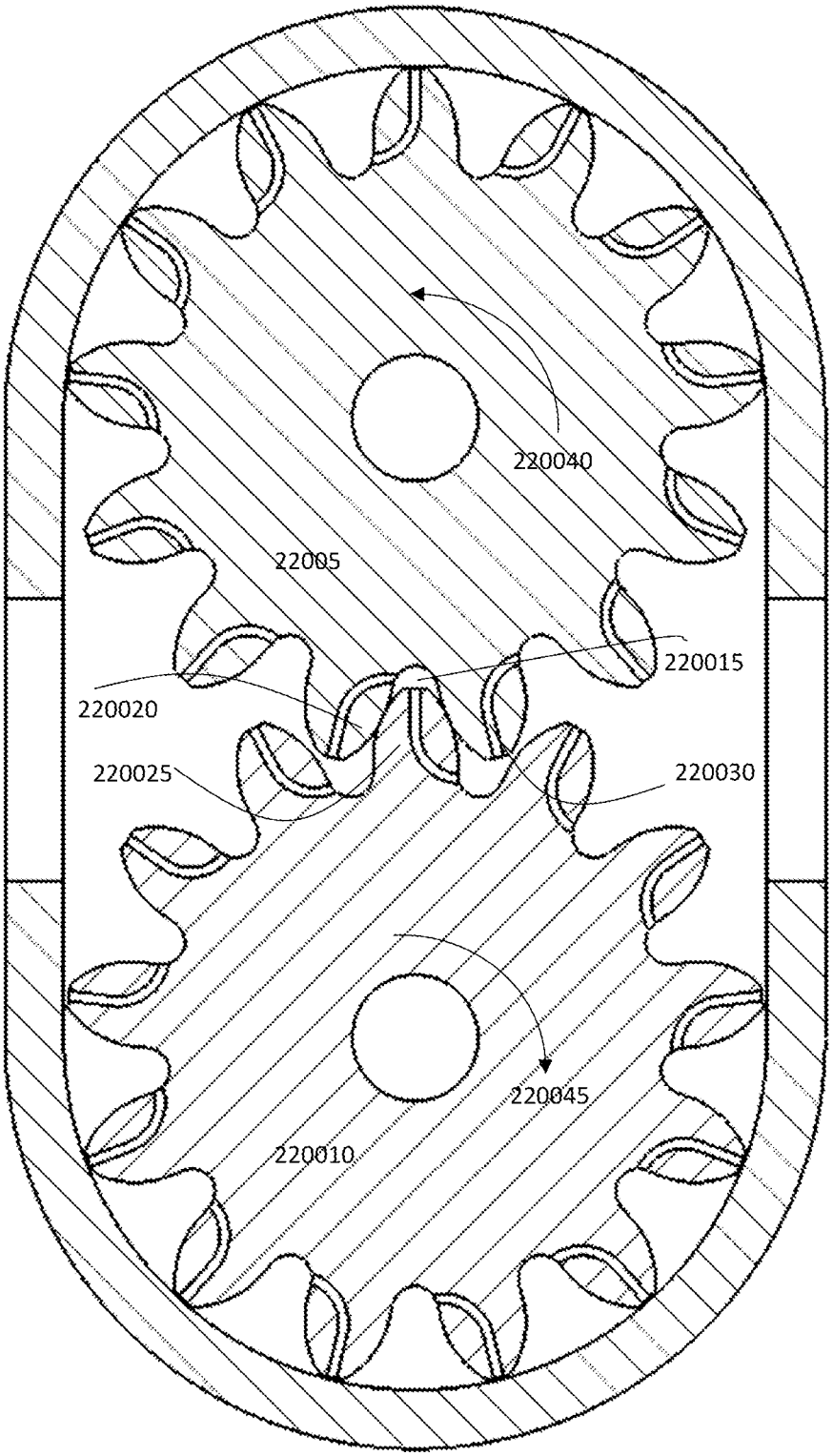
FIG. 22 is an axial cross sectional view of a non-limiting embodiment of a fluid transfer device having two external gear rotors, having fluid flow channels within each tooth of each rotor.

A positive displacement device can include a housing and at least a first rotor and a second rotor with gear teeth that mesh together at a portion of the device. A positive displacement device may also be constructed with additional rotors and such additional rotors are within what is disclosed here. Either one of the two rotors in a meshing pair of rotors may be considered the first rotor and the second rotor. The first rotor is mounted for rotation within the housing about a first rotor axis and the second rotor is mounted for rotation within the housing about a second rotor axis largely parallel to the first rotor axis. The term "teeth" is used to indicate that they mesh as gear teeth, and does not necessarily imply a radially oriented structure. These devices can include devices in which one rotor is an inner rotor located within another rotor which is an outer rotor, the outer rotor meshing with the inner rotor as an internal gear. FIGS. 1-21 disclose embodiments according to the present disclosure with an inner rotor and an outer rotor. A positive displacement device can also comprise two external gear rotors that mesh side-by-side. FIG. 22 discloses an embodiment according to the present disclosure with two external gears arranged side by side, with teeth that mesh as external gear teeth. The external gears are shown as the same size, but could be different sizes.

At a portion of the device away from the meshing, the rotors may have sealing contact with the housing for positive displacement of fluid. The "housing" here may include any element fixed within the housing, for example an insert mounted between the rotors, such as a crescent-shaped seal (also referred to as crescent seal) of an internal gear arrangement. Fluid may travel through the device in first rotor chambers defined between first rotor teeth and second rotor chambers defined between the second rotor teeth. These chambers may be substantially closed and constant volume at this portion of the device.

At a meshing portion of the device, the first rotor teeth and the second rotor teeth mesh together. This meshing will first be discussed in relation to how the teeth enter into and exit meshing.

The teeth of the first rotor enter into meshing with the teeth of the second chamber at an outlet portion of the device. The housing may define an outlet flow channel, at least the first rotor chambers being open to the outlet flow channel in the outlet portion of the device. Here, we are defining the first rotor as the rotor with chambers open directly (i.e. not via the chambers of the other rotor) to the outlet in embodiments where only one rotor has chambers open directly to the outlet. For example, in specific internal gear examples described below, only the outer rotor chambers may be directly open to the outlet. In other embodiments (not shown) only the inner rotor chambers may be directly open to the outlet. Also, both may be directly open to the outlet, as in FIG. 22. As the teeth enter into the meshing, this reduces the collective volume of the first rotor chambers and the second rotor as they move through the outlet portion of the device. At least in part of the outlet portion of the device, the first rotor chambers may be open to the second rotor chambers even without additional features described below.

The teeth of the first rotor leave meshing (unmesh) with the teeth of the second rotor at an inlet portion of the device. The housing may define an inlet flow channel, at least the first rotor chambers or at least the second rotor chambers being open to the inlet flow channel in the inlet portion of the device. Where only the first rotor chambers were directly open to the outlet in the outlet portion, either the first rotor chambers or second rotor chambers or both may be open to the inlet in the inlet portion, for example in an internal gear pump with a radially inward inlet and a radially outward outlet. In the specific examples shown below, the first rotor chambers are open to the outlet. As the teeth enter unmesh, this reduces the collective volume of the first rotor chambers and the second rotor as they move through the inlet portion of the device. At least in part of the inlet portion of the device, the first rotor chambers may be open to the second rotor chambers even without additional features described below.

Figure 18:
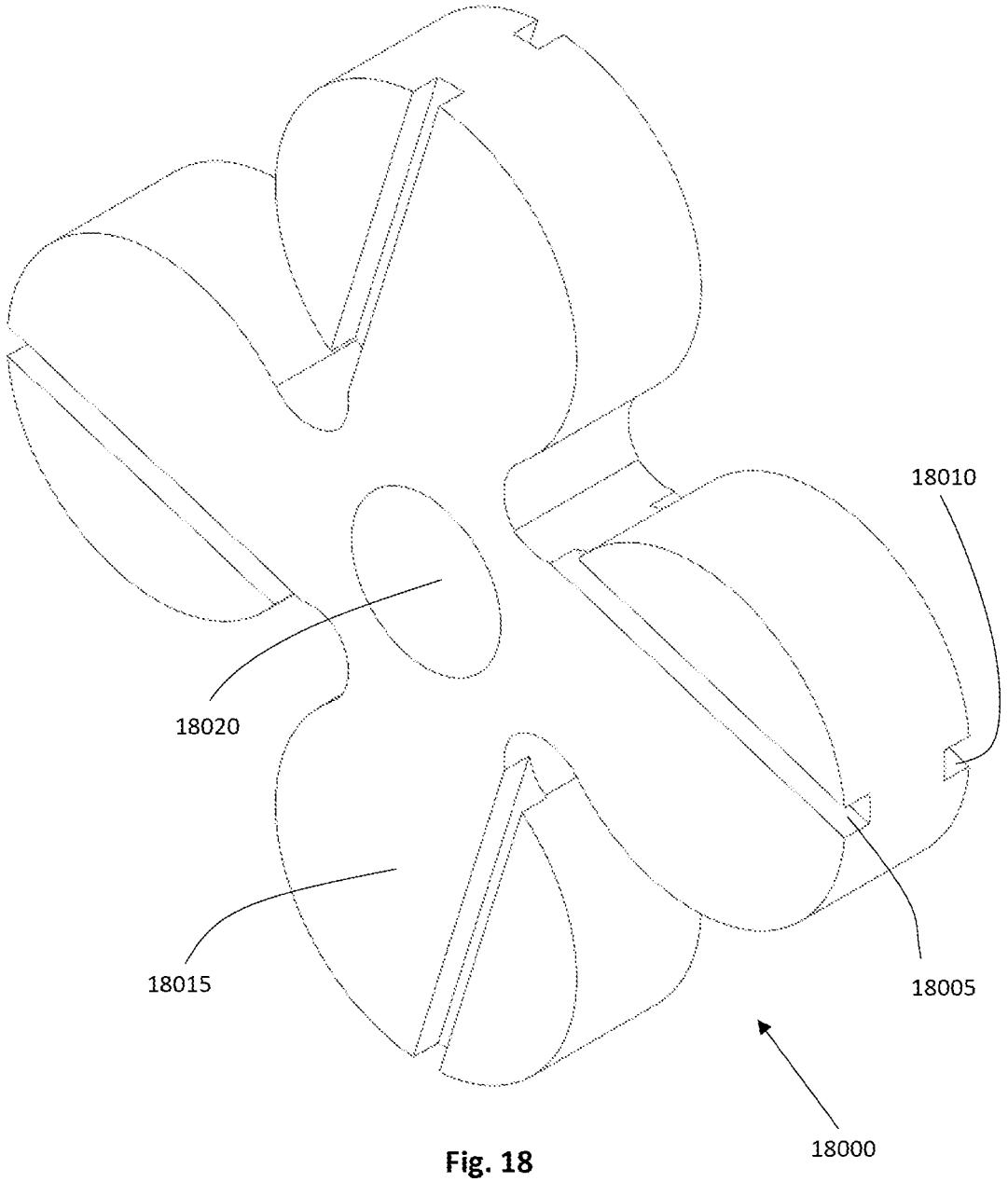
FIG. 18 is a pictorial view of an inner rotor as may be used in embodiments of the disclosed fluid transfer device, having fluid flow channels on both axial ends of the inner rotor.

As the teeth move from the outlet portion to the inlet portion through the meshing portion, in the absence of additional features the first rotor chambers may become sealed by the teeth of the second rotor, the second rotor chambers may become sealed by the teeth of the first rotor, or both. This may lead to water hammer or turbulence. Thus, it is proposed to connect the first rotor chambers and the second rotor chambers using internal flow channels defined by the first rotor, second rotor or both. The word internal here refers to internal relative to non-axial bearing surfaces interfacing with the other rotor. Embodiments, such as shown in FIG. 18, may have flow channels on an axial surface; this axial surface may, in some embodiments, contact an endplate of the other rotor. In some cased, the internal flow channels may connect the otherwise sealed chambers directly to the inlet or to the outlet, and to the chambers of the outer rotor only indirectly via the inlet or outlet. In these cases, the word "connect" is used in this document to encompass this indirect connection. Using internal flow channels allows teeth surfaces to bear against each other with a high surface area, thereby improving the likelihood of establishing and maintaining a fluid film and reducing contact stresses. Further details are discussed below in respect of specific embodiments. In some embodiments, one of the first rotor and the second rotor is an outer rotor and another of the first rotor and the second rotor is an inner rotor. The teeth of the outer rotor (outer rotor teeth) may for example be shaped as fins with generally straight leading fin surfaces and generally straight trailing fin surfaces. For convenience, the outer rotor teeth are referred to in the description as fins though non-fin shaped embodiments are also contemplated. The teeth of the inner rotor (inner rotor teeth) may for example be shaped as lobes including rounded leading lobe surfaces and rounded trailing lobe surfaces. For convenience, the inner rotor teeth are referred to in this description as lobes though non-lobe shaped embodiments are also contemplated. The terms "leading" and "trailing" are defined by the rotation of the outer rotor, which also corresponds to the direction of rotation of the inner rotor in an internal gear embodiment. The leading lobe surfaces are arranged to contact the trailing fin surfaces and the trailing lobe surfaces are arranged to contact the leading fin surfaces. A crescent seal may be arranged between the inner rotor and the outer rotor. As the inner rotor lobes leave a region of meshing with the outer rotor, they may allow in fluid from an inlet in the housing, which flows between the inner rotor lobes and between the outer rotor fins around the crescent seal, and is ejected into an outlet in the housing as the lobes reenter the region of meshing with the fins. The device may be operable as a pump, such that the inner rotor or the outer rotor is driven to induce the fluid flow, or may be operable as a hydraulic motor, where the inner rotor or the outer rotor is driven by the fluid flow to rotate a shaft, or may be operable as either a pump or a hydraulic motor.

Fin and Lobe Shapes

Figure 15:
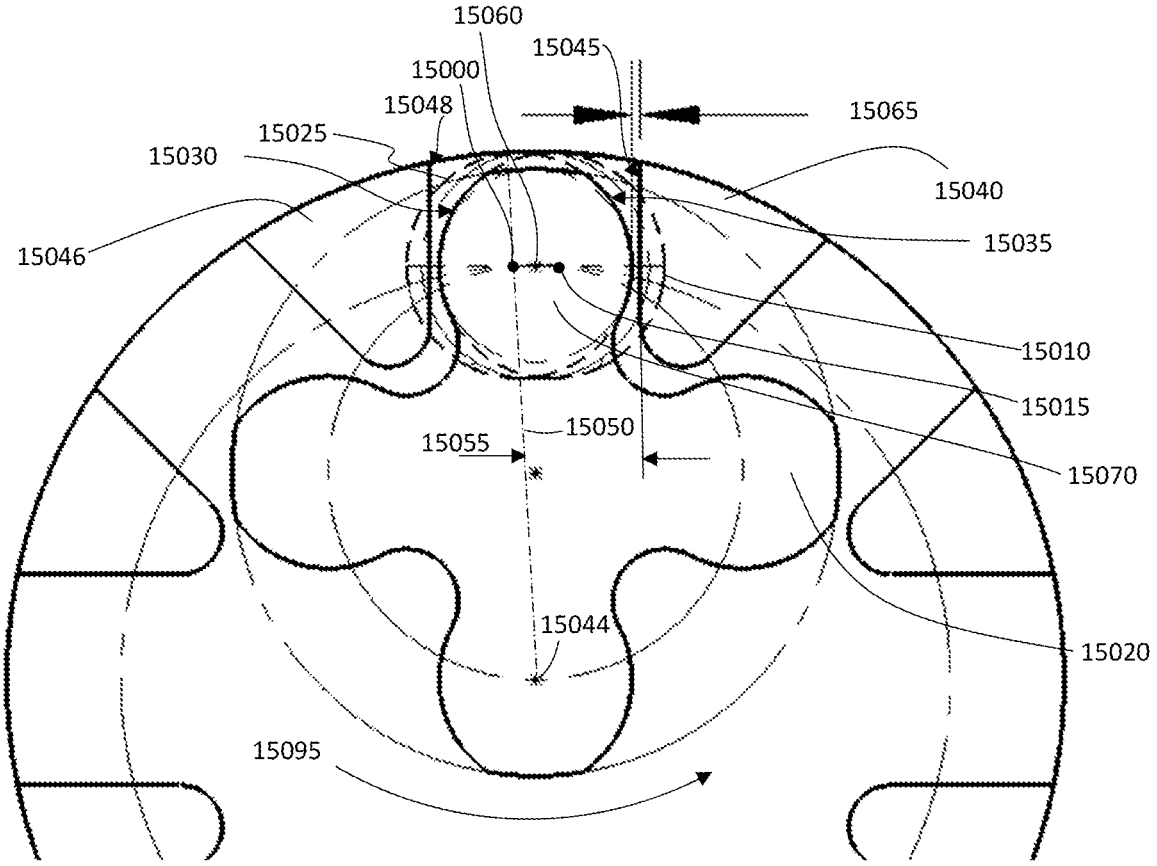
FIG. 15 is a schematic depiction of the geometry used to construct a non-limiting embodiment of a fluid transfer device.

Throughout this document, where a specific shape is described, for example flat or rounded, the shape may occur in cross section in a plane perpendicular to the outer rotor axis. In cross section in other planes perpendicular to the outer rotor axis, the same shape may be present (e.g. an arc corresponds to a cylinder section surface), or may be present but rotated (e.g. helical shape, not shown), or there may be further variations subject to any requirements for the desired meshing. In some embodiments with fin shaped outer rotor teeth and lobe shaped inner rotor teeth, particularly where the outer rotor fins number twice the inner rotor lobes (a 2:1 embodiment), the fins and lobes may be more specifically shaped so that the leading and trailing fin surfaces are straight and the leading and trailing lobe surfaces are circular arcs. Where the fins number twice the lobes, there is a particular radius on the inner rotor where portions of the inner rotor at this radius travel in straight radial lines relative to the outer rotor axis. By locating the centers of the circular arcs at this radius, the inner rotor lobes can maintain sealing contact with straight surfaces of the outer rotor fins continuously for a portion of the rotation of the rotors. In a 2:1 embodiment, each lobe may make contact with two adjacent fins on one side and two adjacent fins on the other, and never with any other fins, while a fin will make contact with two adjacent lobes and never with any other lobes. Thus, it is not in principle required to make the lobes rotationally symmetric with each other, nor the fins rotationally symmetric with each other (except that each fin should be generally symmetric with its opposite fin). For convenience, it is expected that rotationally symmetry will generally be used. In the embodiments shown in the figures, the outer rotor fins are rotationally symmetric about the outer rotor and the inner rotor lobes are rotationally symmetric about the inner rotor. A leading surface of a fin and a corresponding trailing surface of a lobe may be related as follows and as shown in FIG. 15. A first fin 15040 of the outer rotor fins may have a leading first fin surface 15045 of the leading fin surfaces parallel to and displaced in the trailing direction from a first radial line 15050 through the outer rotor axis by a first displacement amount 15055. Note that the difference in position of arc center 15000 relative to lobe center 15060 of first lobe 15070 is exaggerated, so that the radial line 15055 does not appear parallel to leading edge 15045. Also, in some embodiments the fin surfaces of successive fins may be made parallel, even if the arc centers are not concentric. In this case, the radial line 15050 may be moved to instead correspond to the path of travel relative to the outer rotor of the lobe center 15060. Thus, to maintain continuous sealing contact, over a portion of the rotation of the device, between the leading first fin surface and the trailing first lobe surface, the trailing arc shape may have a trailing arc radius substantially equal to, or equal to less a clearance value such as clearance value 15065, the first displacement amount. Alternatively, the distance across the lobe 15070 may be configured to be substantially equal to, or equal to less a sum of clearance values, the first displacement value.

Likewise, a trailing surface of a fin and a corresponding leading surface of a lobe may be related as follows and as shown in FIG. 15. A second fin 15046 of the outer rotor fins may have a trailing second fin surface 15048 of the trailing fin surfaces parallel to and displaced in the leading direction from a second radial line (not shown, but passing through arc center 15015) through the outer rotor axis 15044 by a second displacement amount. The second radial line may correspond to the path of travel relative to the outer rotor of the leading arc center 15015 of first lobe 15070. Again, the difference in position of arc center 15015 relative to lobe center 15060 of first lobe 15070 is exaggerated, so that the radial line through arc center 15015 would not appear in this figure parallel to leading edge 15045. Also, in some embodiments the fin surfaces of successive fins may be made parallel, even if the arc centers are not concentric. In this case, the radial line 15050 may be moved to instead correspond to the path of travel relative to the outer rotor of lobe center 15060 of the first lobe 15070. Thus, to maintain continuous sealing contact, over a portion of the rotation of the device, between the trailing first fin surface and the leading first lobe surface, the trailing arc shape may have a leading arc radius substantially equal to, or equal to less a first clearance value, the second displacement amount.

Figure 19:
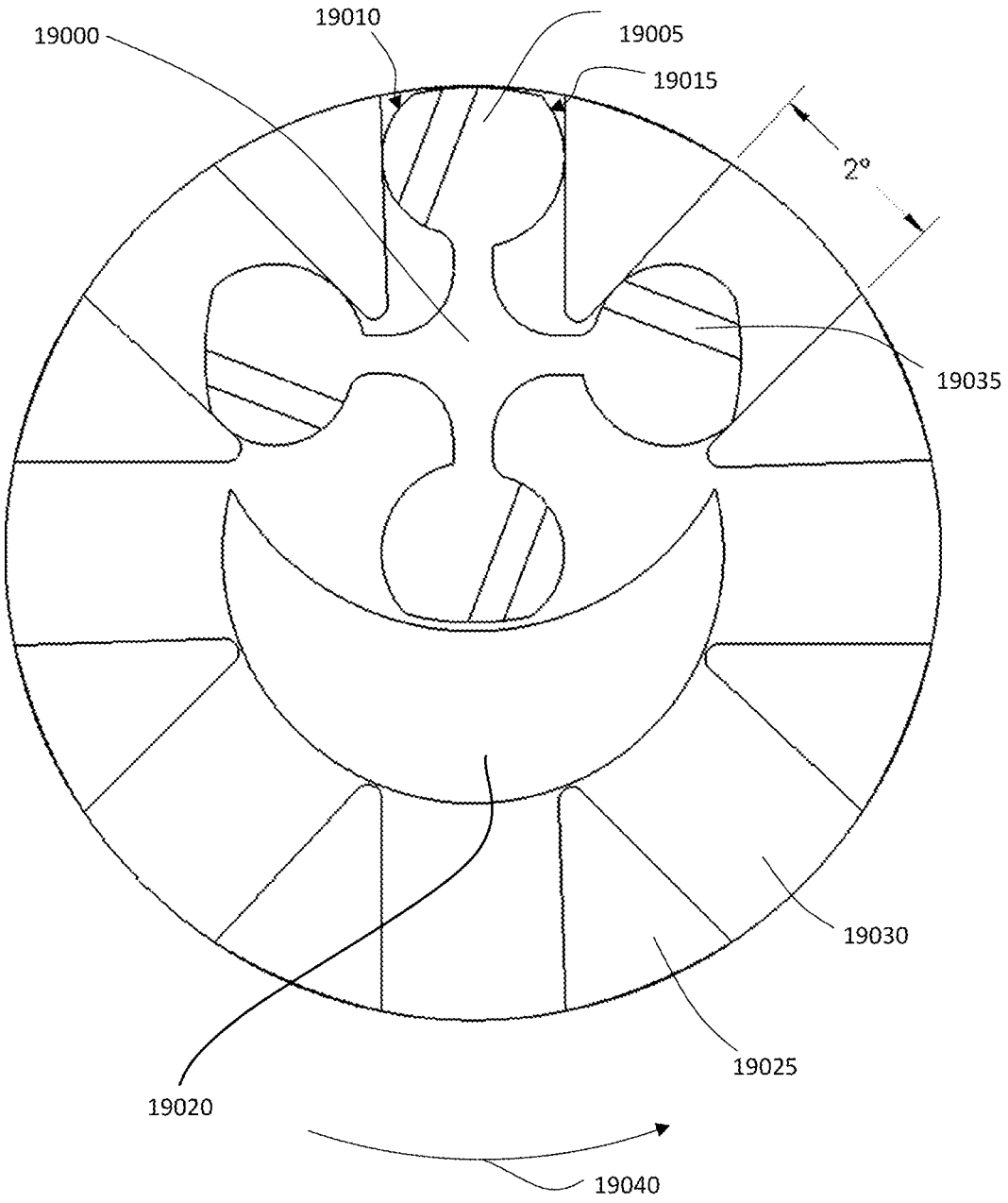
FIG. 19 is a schematic axial view of a non-limiting embodiment of a fluid transfer device having an inner rotor having leading and trailing surfaces defined by arcs of different diameters.
Figure 20:
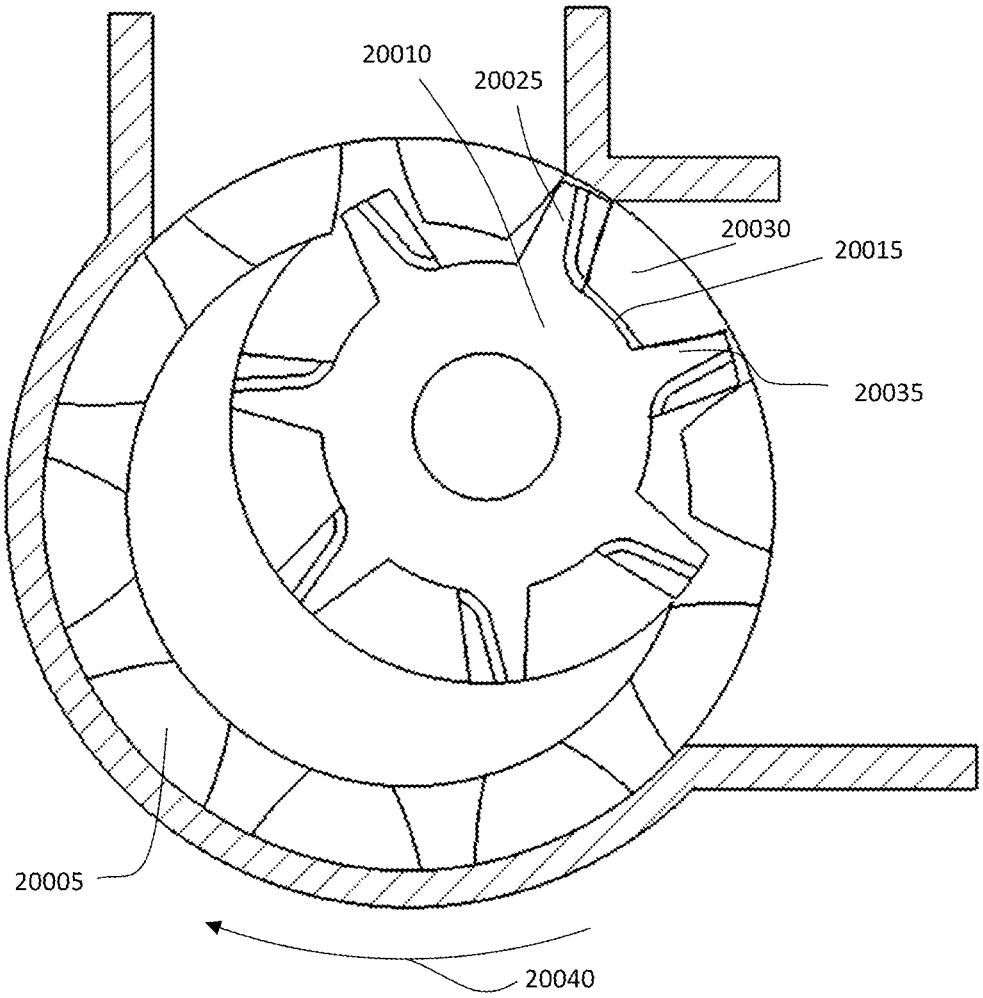
FIG. 20 is an axial cross sectional view of a non-limiting embodiment of a fluid transfer device having inner rotor teeth, who's leading and trailing surfaces are not defined by arcs and having fluid flow channels within the teeth of an inner rotor.
Figure 21:
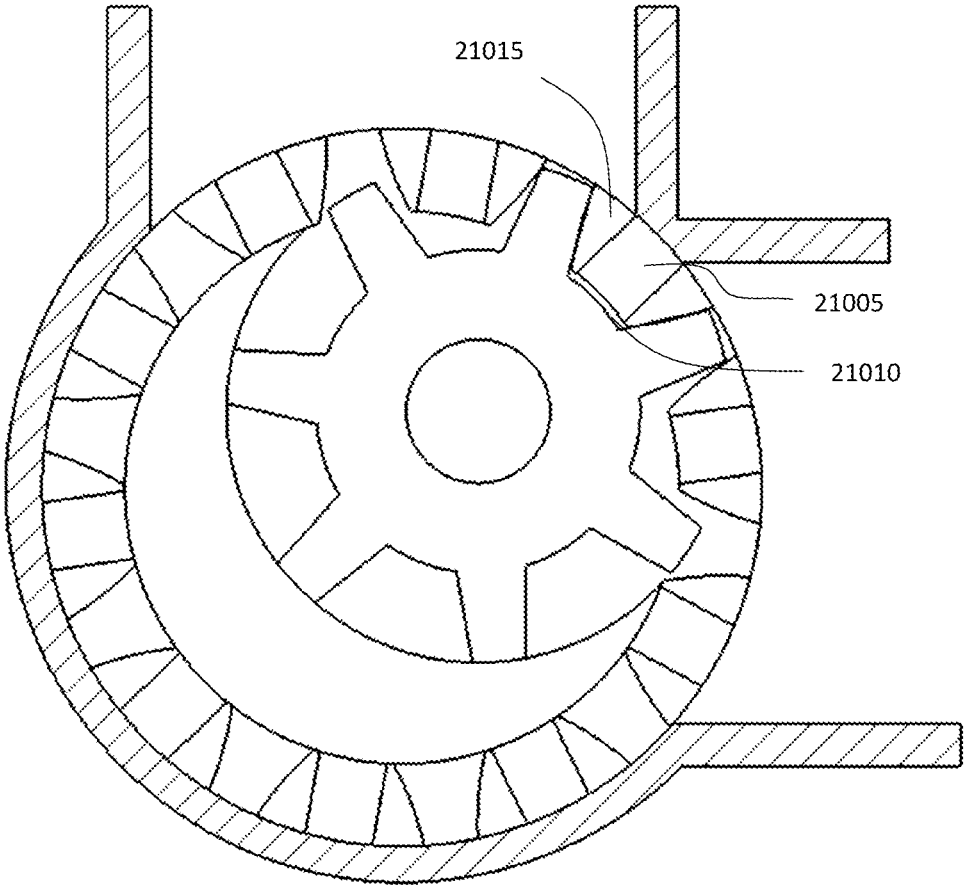
FIG. 21 is an axial cross sectional view of a non-limiting embodiment of a fluid transfer device having inner rotor teeth, whose leading and trailing surfaces are not defined by arcs and having fluid flow channels within the inward projections of an outer rotor.

The second displacement amount may be equal to or different from the first displacement amount. The leading and trailing surfaces, even on the same lobe, could thus have different arc radii. In most specific embodiments shown in the figures, the displacement amounts, and thus the arc radii, are the same. FIG. 19 shows an embodiment where the displacement amounts are not equal.

In an embodiment where the arc center of leading and trailing cylindrical section surfaces of the inner rotor are coincident, the path of the contact between the leading surface of an inner rotor lobe and the trailing surface of a corresponding fin on the outer rotor may be parallel to the path of the contact between the trailing surface of a lobe on the inner rotor and the leading surface of a corresponding fin on the outer rotor. Thus, considering one lobe as both the "first lobe" and "second lobe" described above, where the trailing arc shape is concentric with the leading arc shape, the leading first fin surface is parallel to the trailing second fin surface to maintain a constant (including possibly zero) clearance. In other embodiments, the arc centers of leading and trailing cylindrical surfaces of the inner rotor can be non-coincident, as shown in FIG. 15, or leading and trailing cylindrical surfaces can be of different radii. In some embodiments, the arc centers may be at the particular radius from the axis of the inner rotor, mentioned above, such that points at that radius travel in straight radial lines relative to the outer rotor. Thus, the cylindrical surfaces may have continuous contact over a part of the rotation of the inner rotor with an outer rotor surface parallel to and offset from, by the cylindrical surface's radius, the straight radial line along which the arc center of that cylindrical surface travels. Where the leading and trailing surfaces of the inner rotor feet have non-coincident arc centers, the outer rotor fins contacting an inner rotor foot may have non-parallel straight surfaces, and where the leading and trailing surfaces of the inner rotor feet have different arc radii, the outer rotor fin surfaces may have corresponding different offsets from radii of the outer rotor. As noted above sealing surfaces of the outer rotor fins need not be parallel. Variations may be tolerated, for example the inner rotor sealing surfaces need not be perfectly cylindrical.

FIG. 15 shows a non-limiting example of how the geometry of inner rotor 15020 may be derived. Arrow 15095 shows the desired direction of rotation of inner rotor 15020. Inner rotor 15020 has leading edge 15030 and trailing edge 15035. Leading edge 15030 may define a circular arc corresponding to first circle 15010 with first circle (and arc) center 15015. Trailing edge 15035 may defined a circular arc corresponding to second circle 15025 with second circle (and arc) center 15000. In such an embodiment, the outer rotor fin surfaces (not shown) contacting any given inner rotor foot may be non-parallel such that the surfaces are further apart at radii which define a greater distance from the axis of the outer rotor, and conversely in another embodiment where the arc center of the trailing arc surface is ahead of the arc center of the leading arc surface, the pairs of outer rotor fin surfaces contacting any given inner rotor foot may be parallel.

Modifications such as these can be used to bias the rotation force on the outer rotor, which results from fluid pressure, relative to the inner rotor or to increase the proportion of rolling vs sliding contact between the inner rotor lobes and outer rotor fins, or to achieve other desirable effects. lobes 19005 each with a leading surface 19010 and trailing surface 19015 with the radius of leading edge 19010 not equal to trailing edge 19015. In this aforementioned non-limiting embodiment, the radius of trailing edge 19015 is greater than the radius of the leading edge 19010, but the radius of the leading edge 19010 could be configured to be larger than the trailing edge 19015. For reference a crescent 19020 and outer rotor 19030 with radial fins 19025 are shown in FIG. 19. An array of fluid paths 19035 are located within lobes 19005 of inner rotor 19000 and spans from the root between adjacent lobes to the outer diameter of the aforementioned lobe 19005. For reference arrow 19040 shows the direction of rotation.

At least in an embodiment with concentric arc leading and trailing faces of the lobes, and fin surfaces with equal radial extent, When the trailing surface of the inner rotor is in contact or sealing proximity with a leading surface of the outer rotor, the trailing surface of the outer rotor is in contact or sealing proximity with the leading surface of the inner rotor, preventing leakage paths between chambers.

Secondary Chambers

Fluid transfer devices such as those described above as well as conventional gearpumps commonly form secondary chambers which could cause water hammer. A secondary chamber here refers to a chamber of the inner rotor chambers or the outer rotor chambers that is, at a position of the rotation of the device, substantially enclosed by the teeth of the other rotor, and not connected with the inlet, outlet or chambers of the outer rotor except via flow channels as described in this document specifically for the relief of these chambers. For example, the gearpump in FIG. 20 has an outer rotor 20005 and inner rotor 20010 and rotates in the direction indicated by arrow 20040. A secondary chamber 20015 of the inner rotor chambers is formed in a region defined by the sealing contact between a leading edge of an inner rotor tooth 20025 and an outer rotor tooth 20030 and the sealing contact between the trailing edge of an inner rotor tooth 20035 and an outer rotor tooth.

Figure 23:
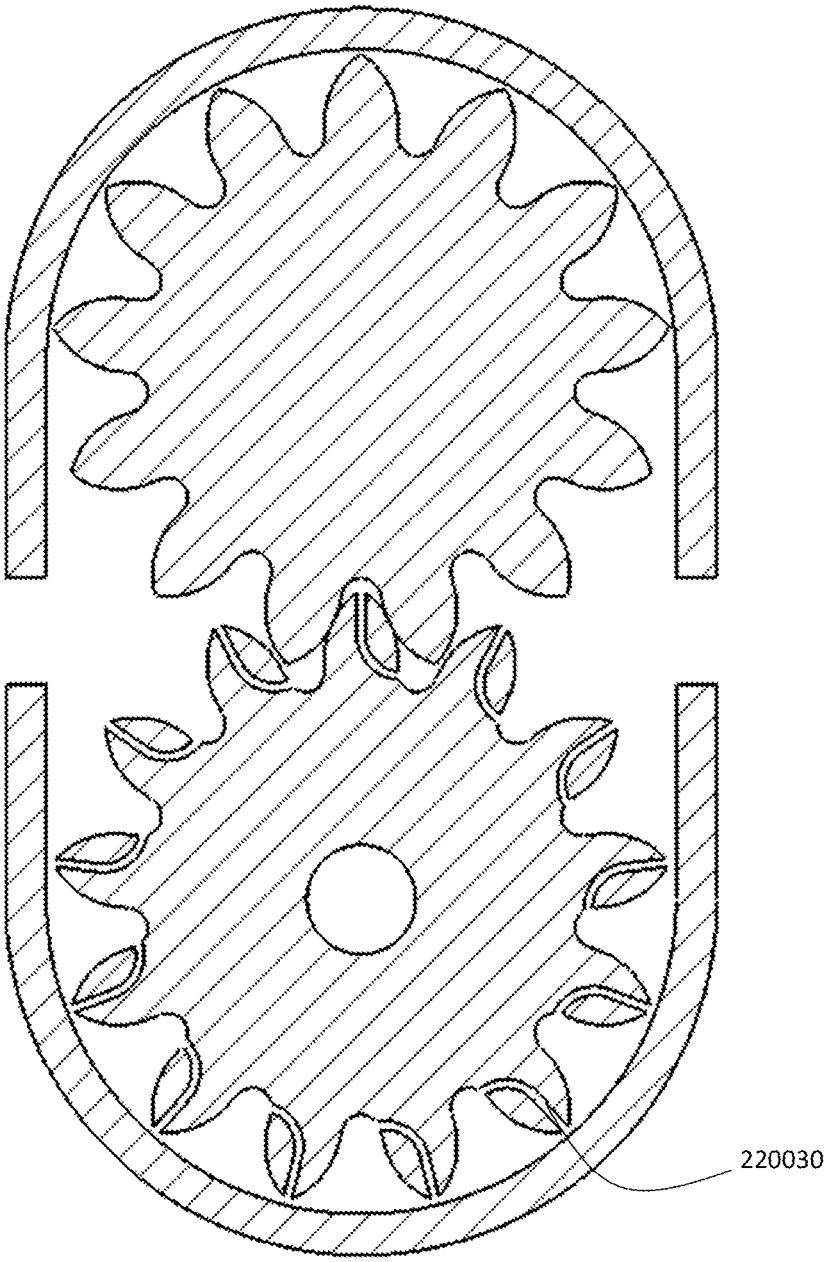
FIG. 23 is an axial cross sectional view of a non-limiting embodiment of a fluid transfer device having two external gear rotors, having fluid flow channels within each tooth of only one rotor.
Figure 24:
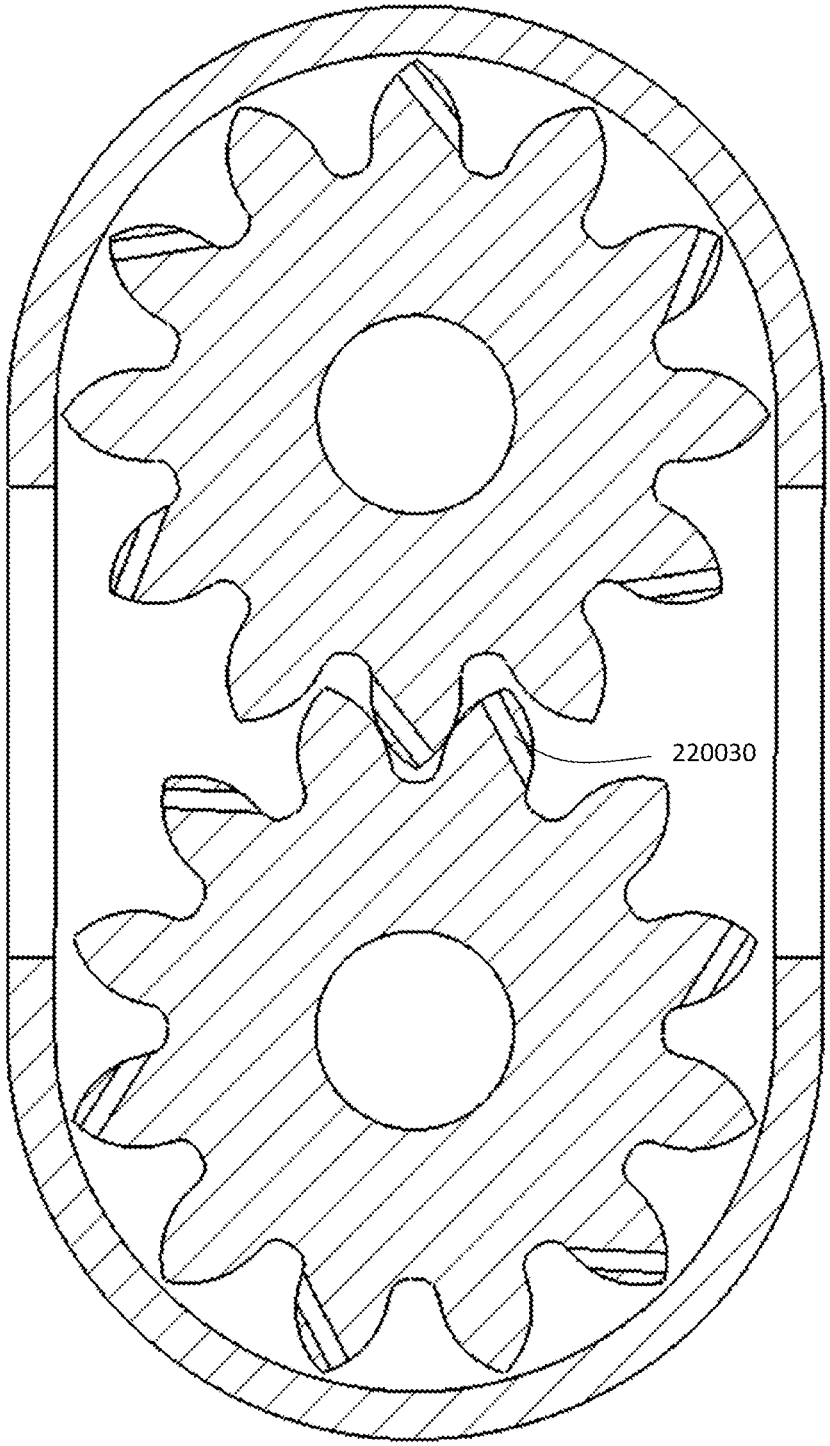
FIG. 24 is an axial cross sectional view of a non-limiting embodiment of a fluid transfer device having two external gear rotors, having fluid flow channels within every other tooth of each rotor.

Similarly, the gearpump shown in FIG. 22 has a first rotor 22005 which rotates in the direction indicated by arrow 22040 and second rotor 22010 which rotates in the direction indicated by arrow 22045. A secondary chamber 22015 of the first rotor chambers is formed by the sealing contact between a leading edge of first rotor outward projection 22020 and second rotor outward projection 22025 and a trailing edge of first rotor outward projection 22030 and second rotor outward projection 22025. Relief is provided by flow paths 22030 provided in both the inner rotor and the outer rotor. In other embodiments, such as that shown in FIG. 23, the flow paths 220030 may be present on only 1 rotor. In other embodiments, such as that shown in FIG. 24, flowpaths 220030 may be present in every second tooth of both rotors.

Other positive displacement fluid devices having secondary chambers are described below.

If there were no flow path out of these secondary chambers, fluid hammer or vacuum spikes would occur during certain operating conditions. In a non-limiting example shown in FIG. 20, flow paths out of secondary chambers are located within the inner rotor outward projections, leading from the area between two adjacent inner rotor outward projections to the tip of the trailing inner rotor outward projection. In another non-limiting example shown in FIG. 21, flow paths 21005 out of secondary chambers, such as 21010 are located within the outer rotor inward projections such as 21015 leading for example between leading and trailing surfaces of the inward projection that come into contact with the inner rotor outward projections between radially outside to radially inside the contact surfaces. The device may be used with any of these flow paths or a combination of them.

Figure 9:
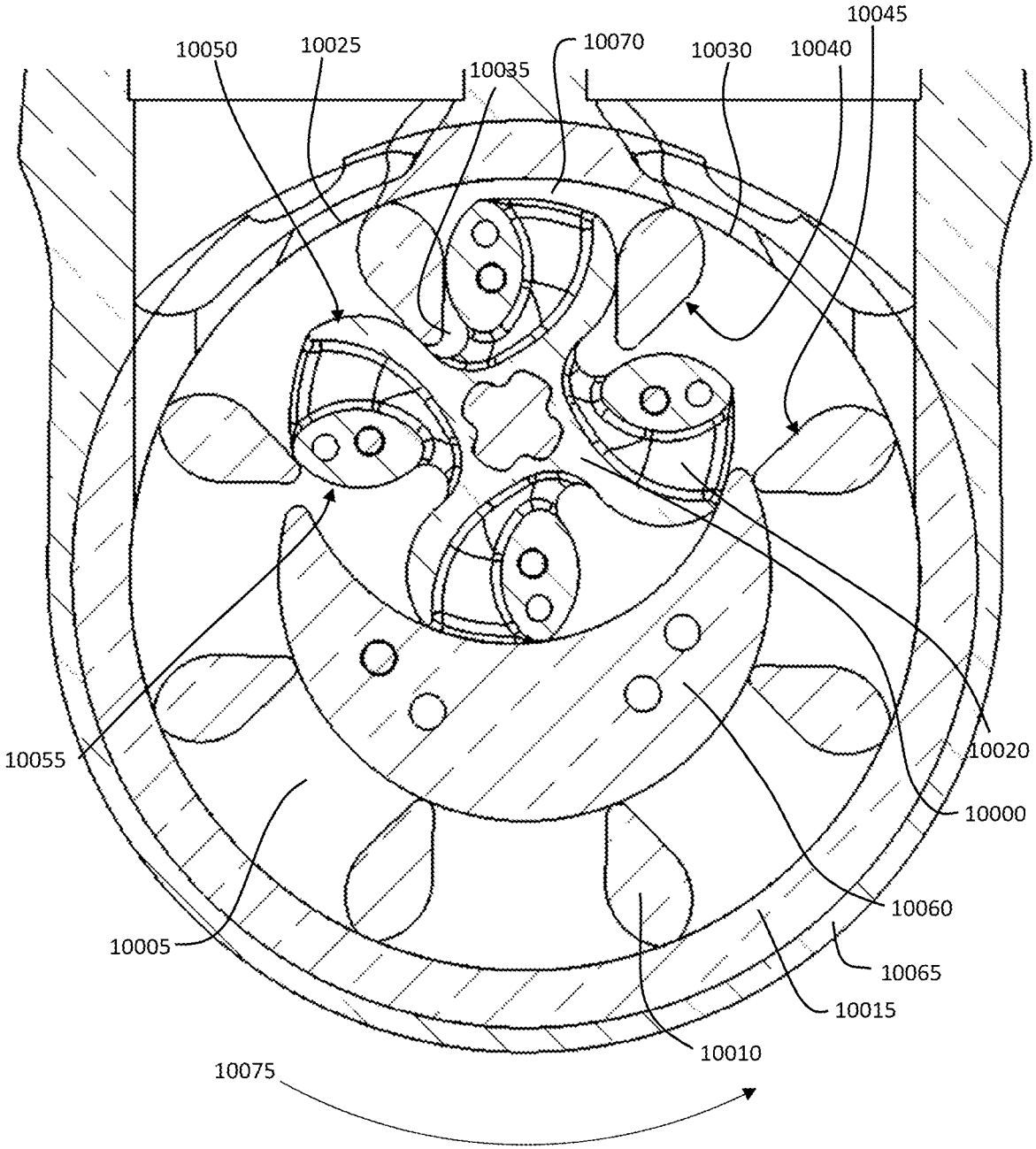
FIG. 9 is an axial cross sectional view of a non-limiting embodiment of a fluid transfer device, having fluid flow channels within lobes of an inner rotor.

In a non-limiting example shown in FIG. 9, flow paths out of secondary chambers such as 10035 are located within the inner rotor lobes, leading from the area at the juncture between two adjacent inner rotor lobes to the tip of the trailing lobe. In another non-limiting example shown in FIG. 10, flow paths out of secondary chambers such as 12035 are located within the outer rotor fins leading for example between leading and trailing surfaces of the fin that come into contact with the inner rotor lobes between radially outside to radially inside the contact surfaces. The device may be used with any of these flow paths or a combination of them.

Figure 1:
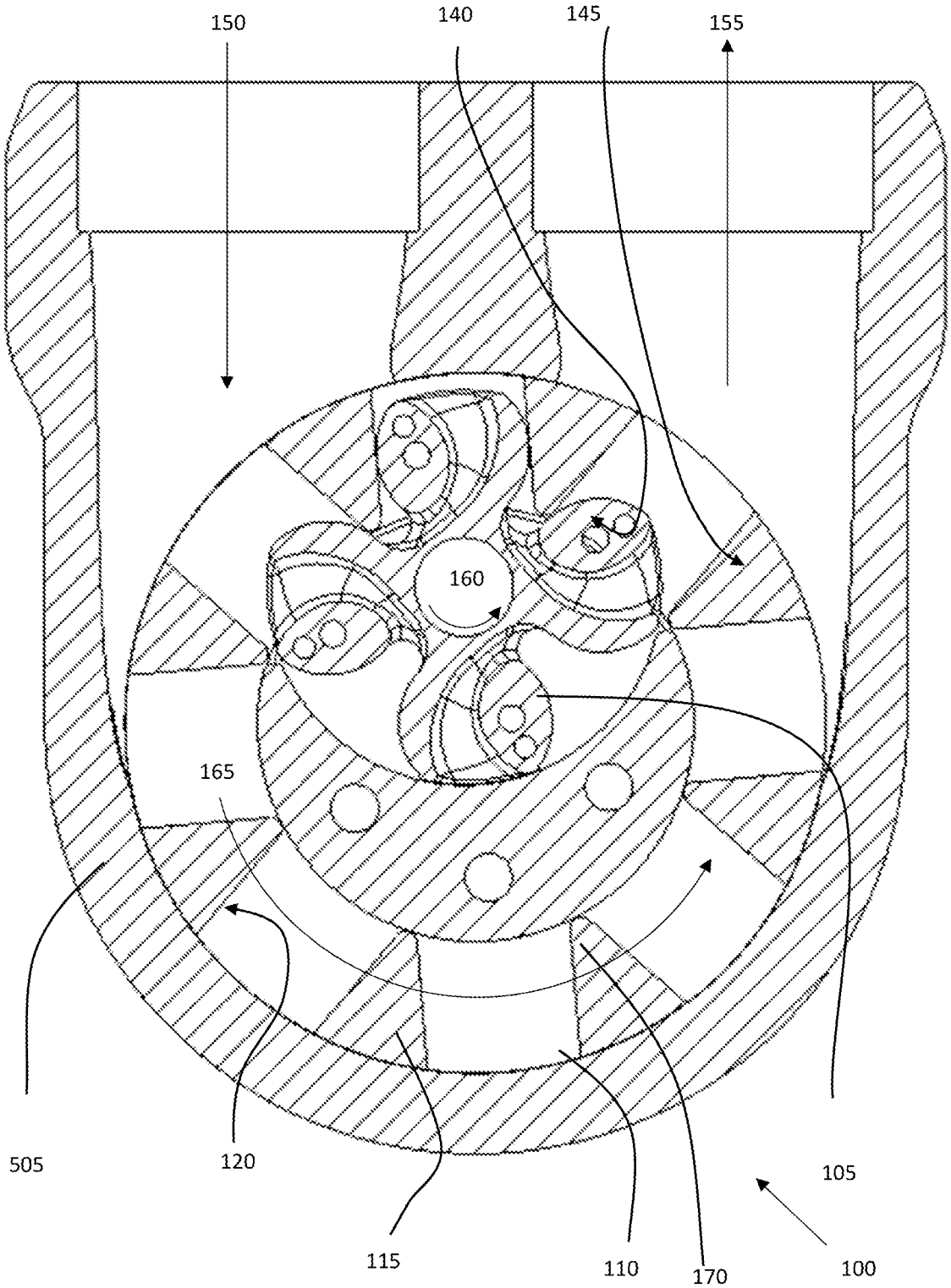
FIG. 1 is an axial cross sectional view of a non-limiting embodiment of a fluid transfer device.
Figure 2:
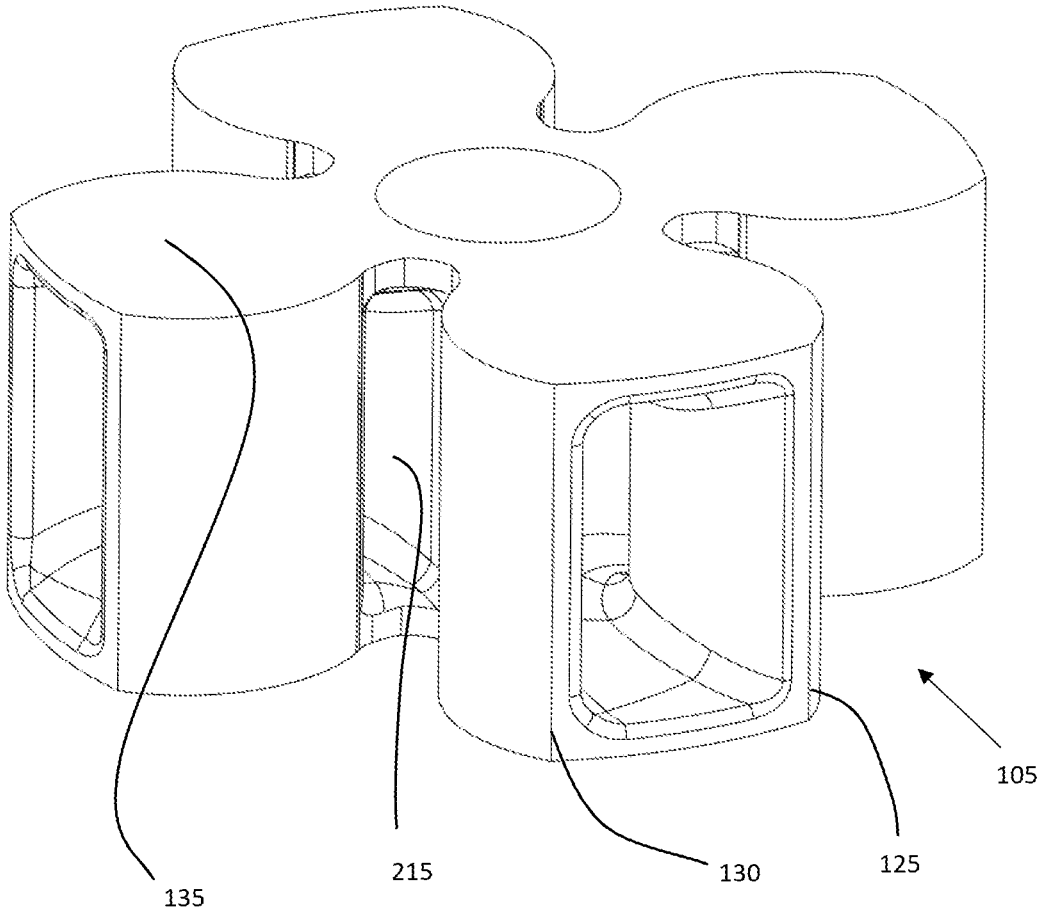
FIG. 2 is a pictorial view of an inner rotor of the embodiment shown in FIG. 1.

In the non-limiting embodiment shown in FIG. 1 a rotary displacement device comprises an outer rotor 110 and an inner rotor 105 rotating and interacting together to form chambers (needs label) which collectively decrease in volume as the inner rotor and outer rotor mesh together in the discharge zone of the pump, and collectively increase in volume in the intake zone of the pump. At full volume, the chambers may be split into inner and outer portions by a crescent seal 170. In a non-limiting embodiment shown in FIGS. 1-14 the inner rotor has 4 radial projections and the outer rotor has 8 radial projections. Many other lobe and fin numbers may be used in a 2:1 ratio. The inventor anticipates that ratios other than 2:1 would also be viable with other numbers of inner rotor and outer rotor projections.

In a non-limiting embodiment shown in FIGS. 1-8 the inner rotor 105 rotates at half the speed of the outer rotor 110. The outer rotor 110 has radial projections 115 (referred to as outer rotor fins 115 in this document) with trailing faces 140 and leading faces 120, 145 that are parallel to but offset from the path of the center of a radius of the outer rotor 110 cylindrical sealing surfaces. These offsets from the radii center points may be selected to accommodate a circumferential diameter of the rotor feet extending between the contacting arcs of the toe 125 and heel 130 of each of the inner rotor feet 135. The leading and trailing offsets from the radius may be, for example, equal. In other embodiments wherein the offsets from the radius are unequal, the diameters of the leading and trailing edges would also unequal. In other words, in the case where these leading and trailing arcs are concentric, as for example in the non-limiting embodiments shown in FIGS. 1-8, the offset between opposing outer rotor faces 120 is defined by the sum of the two radii of the opposing portions of the rotor feet which contact the aforementioned faces outer rotor faces 120. In addition to this offset, an offset equal to the desired gap between the inner rotor and the outer rotor is also added. This offset may be less than 0.001 inches or more than or equal to 0.001 inches. It has been found that 0.002 inches is an acceptable clearance for low to medium pressure pumping of low to high viscosity fluids. In this non limiting embodiment, the inner rotor 105 rotates at half of the speed of the outer rotor 110. Inner rotor 105 has half as many lobes as the number of fins 115 on the outer rotor 110. The direction of rotation of inner rotor 105 is shown by arrow 160. The direction of rotation of the outer rotor 110 is shown by arrow 165. The direction of inlet fluid flow is shown by arrow 150. The direction of output fluid flow is shown by arrow 155. In the non-limiting embodiment shown in FIG. 1, mating component 170 is arranged to interface between the sealing edges of inner rotor 105 and radial projections 115 of outer rotor 110.

Figure 3:
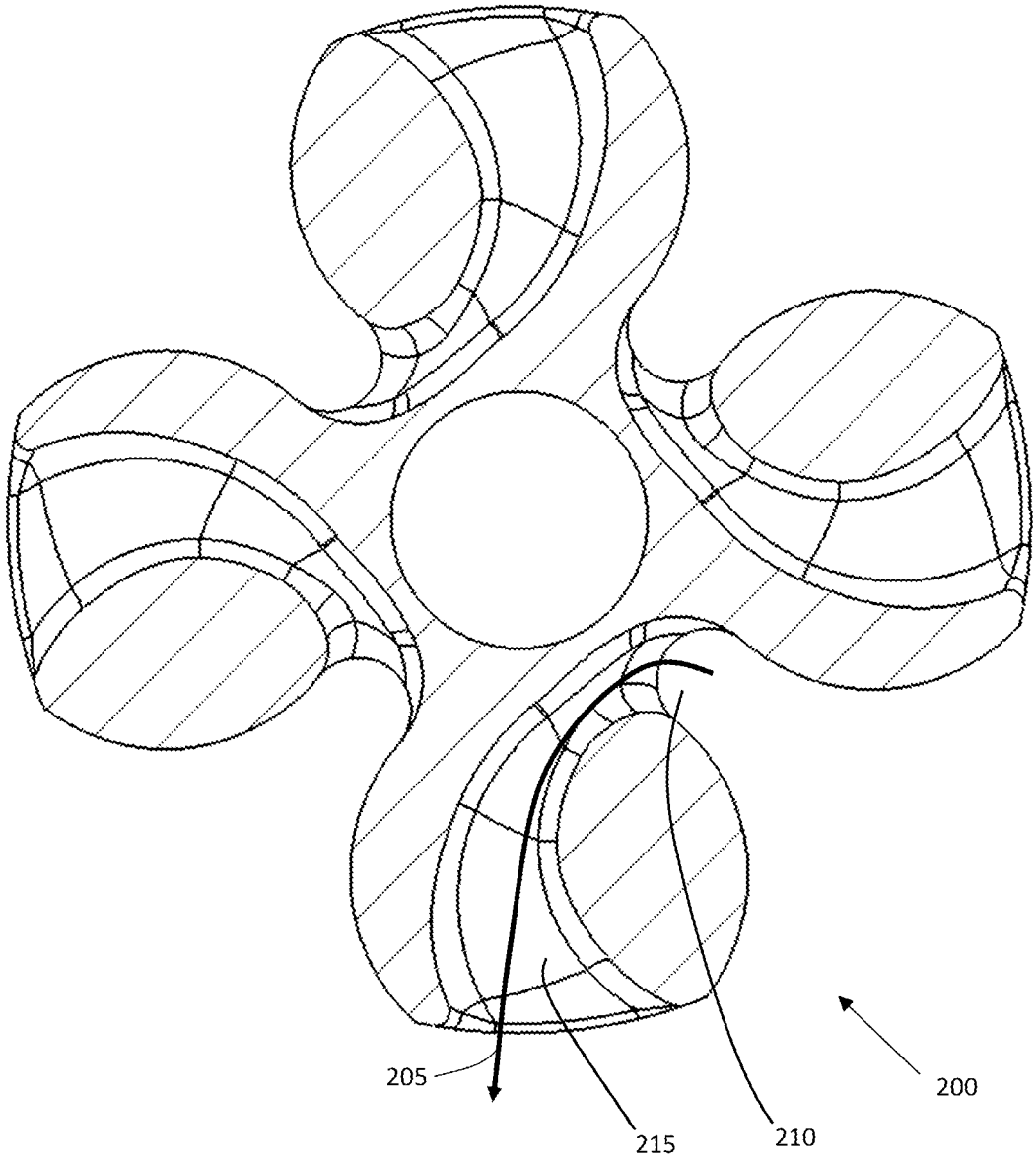
FIG. 3 is an axial cross sectional view of the inner rotor of FIG. 2.
Figure 4:
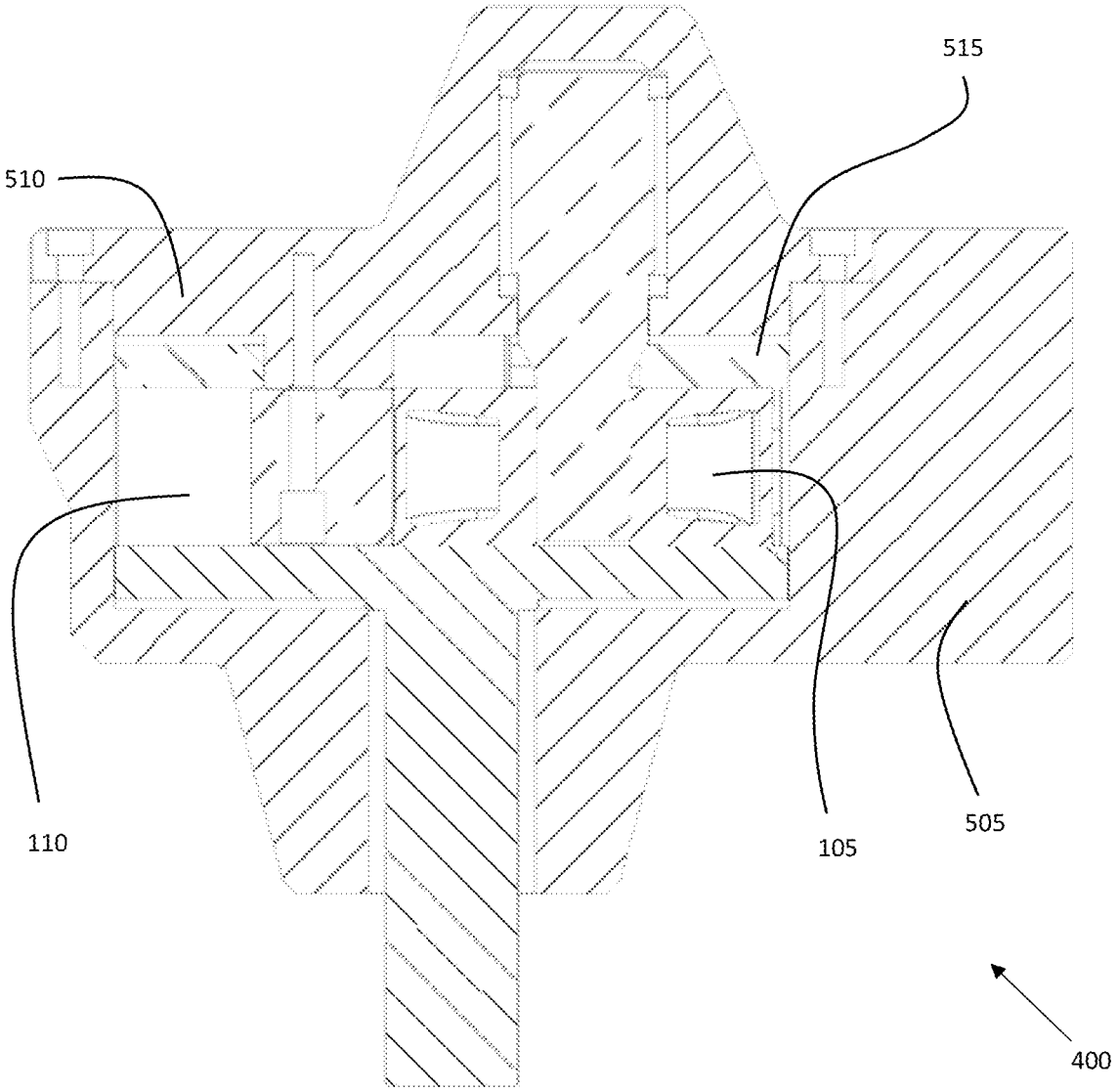
FIG. 4 is a side cross sectional view of a non-limiting embodiment of the disclosed fluid transfer device including an outer rotor shaft that may be linked to external apparatuses.

In this embodiment, the arc of the inner rotor toe 125 is concentric with the arc of the inner rotor heel 130 of the inner rotor feet 135 and both the toe 125 and heel 130 surfaces seal against their corresponding surfaces on the outer rotor 110. For clarity, the leading surface 125 of the inner rotor feet 135 seals against the trailing surface 140 of the outer rotor fin 115 and the trailing surface 130 of an inner rotor foot 135 seals against the leading surface 145 of the opposite outer rotor fin. Inner rotor 105 may have a two-part construction in which each of the two parts are largely mirror images of each other for ease of manufacturing. A non-limiting example of a half rotor 200 of such inner rotor 105 is shown in FIG. 3. A one-piece inner rotor may also have these flow paths in one or both ends rather than along a central plane.

A benefit of this geometry is relatively long circumferential length of the outer rotor fins 115 around the OD of the outer rotor 110. This is beneficial for structural reasons to add rigidity to the outer rotor 110 and provides enough area for both the bolt holes 180 and the dowel holes 175 on the axial ends of the outer rotor fins 115 to attach an outer rotor ring 515, shown for example in FIG. 4, if such a ring 515 is used in an embodiment.

One of the objectives that may be met by embodiments of this device is to reduce the flow resistance of fluid passing through the pump, especially when the pump is operated at high speeds for example to achieve high power density, to operate within a more efficient range for a driving motor, or for other advantageous reasons. Low fluid flow resistance may be achieved by minimizing the directional changes of the fluid in addition to minimizing the turbulence of the fluid which would result from high velocity fluid flow spikes. These high velocity fluid flow spikes may be minimized by the disclosed geometry by reducing or eliminating areas where fluid must flow at high velocities through small gaps. In this exemplary pump of FIGS. 1-8, the cross-sectional area of fluid flow paths is generally proportional to the volume of flow through those paths at any part of the cycle. In other words, the greater the volume of fluid flow through a fluid path, the greater the cross-sectional area of said fluid flow paths.

Another way flow resistance may be minimized in this device is by minimizing the angular acceleration of the fluid as it passes from the inlet to the discharge of the pump. This may be done in several ways. The first is by maintaining a high percentage of the fluid flow throughout the device substantially perpendicular to the first rotor axis. This may be done by minimizing the lateral flow of fluid by drawing fluid into and expelling fluid from the rotors in a generally radial direction relative to the rotor chambers (or a tangential direction relative to the housing). Another way of minimizing angular acceleration of the fluid is by causing the fluid to enter and exit at generally opposite directions from the same side of the pump. This draws fluid in generally on a tangent to the inner and outer rotor and causes it to make a gradual 180° bend along with the outer rotor and along with the inner rotor after which these two fluid paths are combined again on generally a tangent as they leave the rotors and the pump.

Figure 5:
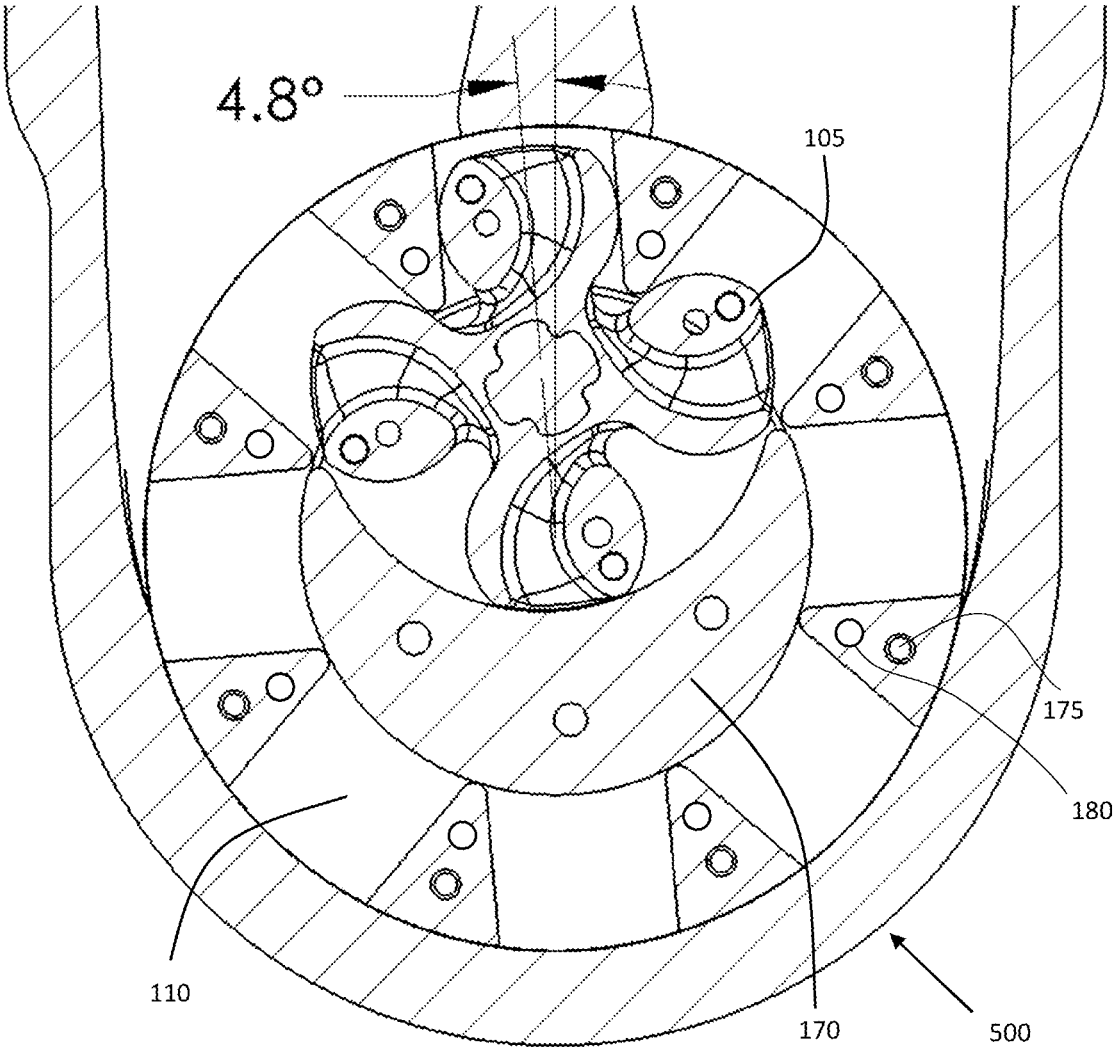
FIG. 5 is a cross sectional view of the embodiment of FIG. 1 showing an angle between a Top Dead Center (TDC) position and a point equidistant between an inlet and an outlet.

In order to achieve low flow resistance, each secondary chamber (which is formed between two adjacent feet of the inner rotor and a fin on the outer rotor) must have a path to flow to the output port as that secondary chamber reduces volume. The secondary chamber must also have a path to the inlet port when the secondary chamber increases volume. If this flow path does not exist, water hammer or vacuum spikes will occur. In this pump geometry, as shown in FIG. 3, a fluid flow path shown by arrow 205 is provided inside each foot 135 of an inner rotor 105 from the apex 210 between two feet to the OD of an adjacent foot. Each passage 215 allows fluid flow from each apex to each foot OD adjacent to it in the same direction. The housing seal between the inlet and output port is then shifted (or the position of the inner rotor axis is shifted) so the volume at TDC (including the volume at the OD of the foot at TDC and the volume in communication with it in the adjacent apex, is the minimum possible volume. In the exemplary embodiment of the pump 500 shown in FIGS. 5 to 8 the angle shift of the inner rotor axis around the main axis of the pump is 4.8 degrees. This offset is shown in FIG. 5. Other angles can be used for other embodiments with the objective of sealing a chamber to prevent fluid flow from the discharge port to the intake port when the chamber is at its smallest volume. Additionally, other housing seal geometries may be employed in embodiments where, for example, preventing leakage is critical or non-essential or preventing fluid hammer is critical or non-essential.

Figure 6:
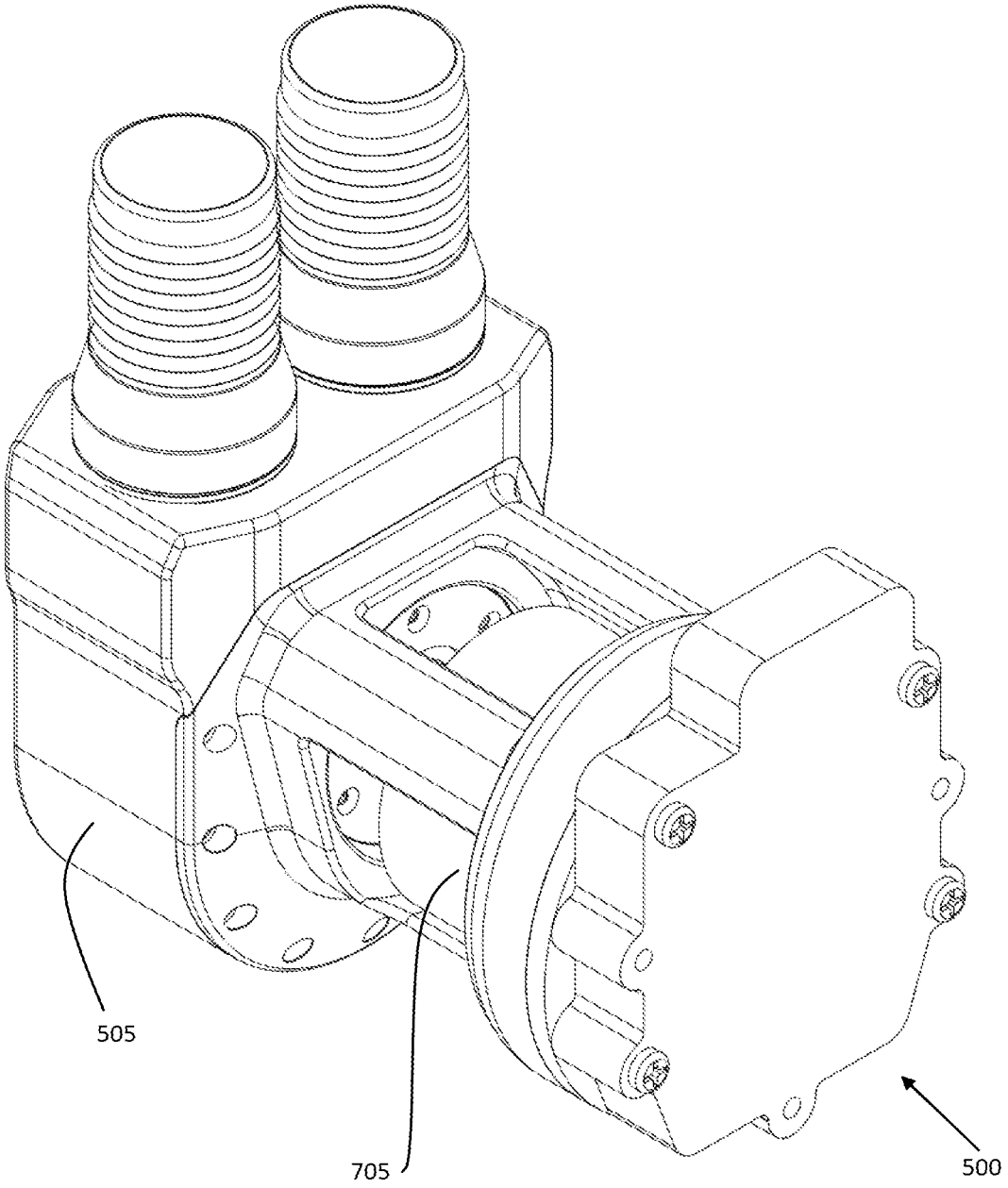
FIG. 6 is a pictorial view of a non-limiting embodiment of a fluid transfer device configured to be driven by or drive an electric machine.
Figure 7:
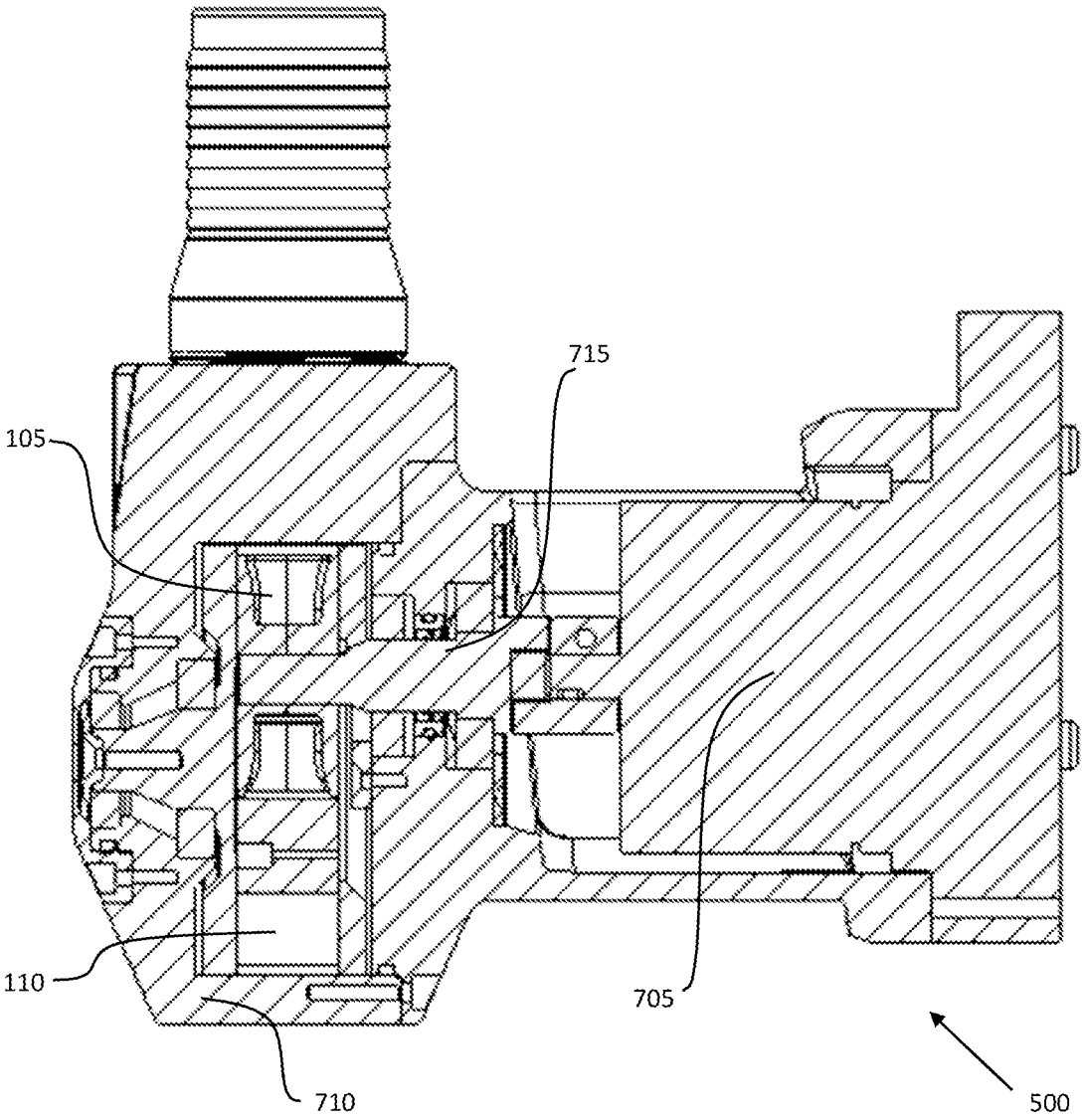
FIG. 7 is a side cross sectional view of the fluid transfer device depicted in FIG. 6.
Figure 8:
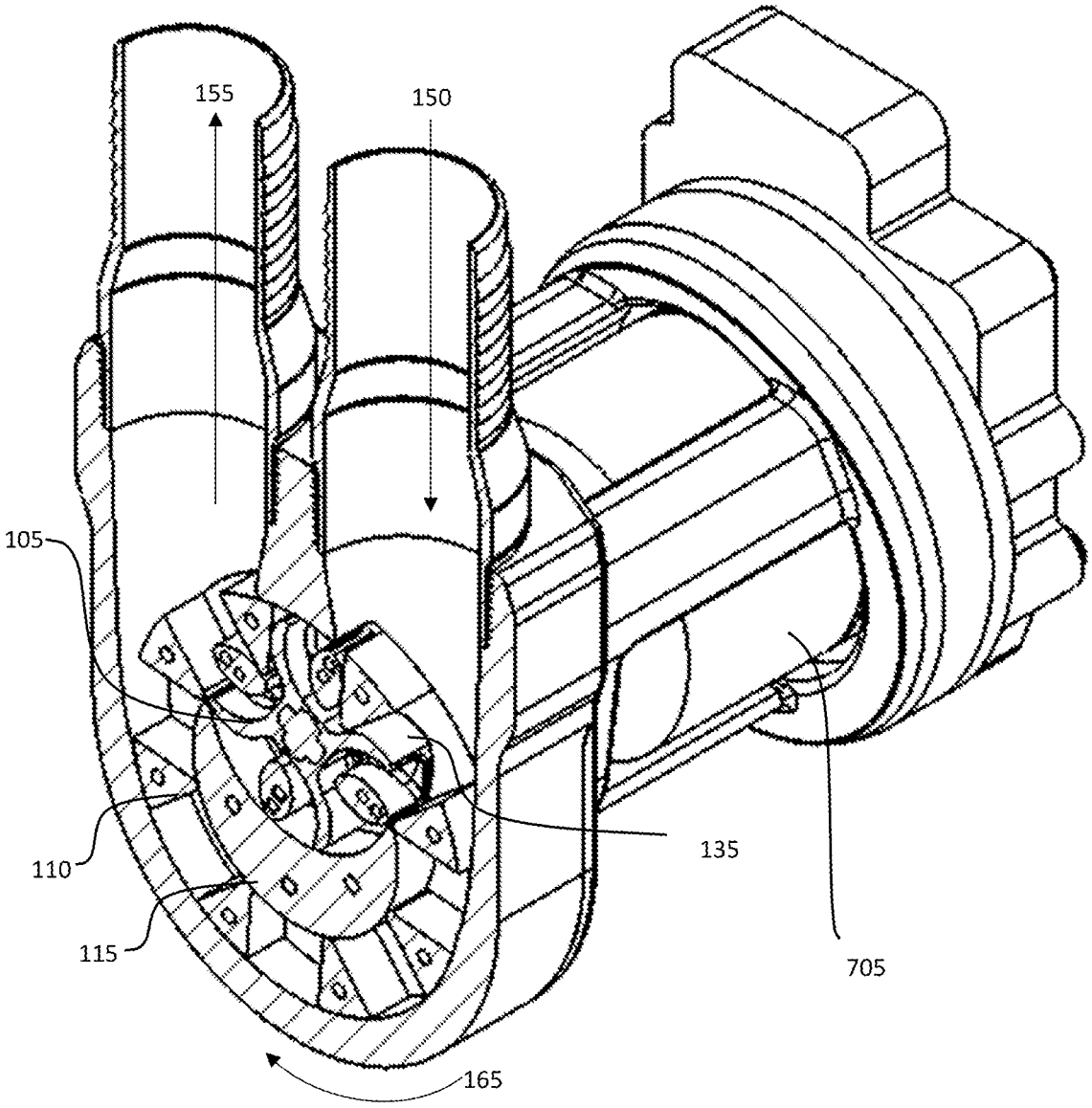
FIG. 8 is a cutaway isometric view of the fluid transfer device depicted in FIG. 6.

The embodiment shown in FIGS. 5-8 features an integrated motor 705, shown in FIGS. 6-8. In an embodiment shown in FIG. 7 a motor 705 is used to power the inner rotor 105 via input shaft 715. In this non-limiting embodiment, the outer rotor 110 is assembled to rotate within a lower housing 505 and is powered via the interaction between the inner rotor feet 135 and the outer rotor projections 115. In an alternate configuration (not shown) outer rotor 110 may be arranged to be powered by a motor and the inner rotor 105 may be arranged to rotate about its axis relative to the upper housing 510. In another non limiting example, fluid flow supplied to the energy transfer machine may be used to generate mechanical power, output through the shaft of either the inner rotor or the outer rotor. Where an electric machine is configured for use as a generator and coupled to the power-producing shaft, electrical power may be produced from the fluid flow through the machine.

Tear Drop Outer Rotor Fins

In the non-limiting embodiment shown in FIG. 9, the outer rotor 10005 radial projections 10010 have a teardrop shape which reduces drag on the trailing edge 10040 of the outer rotor 10005 radial projections 10010. The leading edge of the outer rotor 10005 radial projections 10010 may also have a teardrop shape to reduce turbulence of fluid flowing past the leading edge 10045 of the radial projection 10010. The direction of rotation of the inner rotor 10000 and outer rotor 10005 is shown by arrow 10075. The housing 10065 may have a sleeve 10015 which seals against the outer diameter of the outer rotor 10005. The sleeve 10015 may be made from a material with favorable wear and machinability characteristics such as brass. The crescent 10060 may be made from a material with favorable wear and machinability characteristics such as brass. The inlet port 10025 and exhaust port 10030 are also shown in FIG. 9. The inlet port 10025 defines the point at which the primary chamber opens to the inlet side of the pump and the discharge port 10030 defines the point at which the primary chamber 10070 closes to the discharge flow path of the pump. For reference a secondary chamber 10035, leading edge 10055 of the inner rotor 10000, trailing edge 10050 of the inner rotor 10000 are shown.

Figure 10:
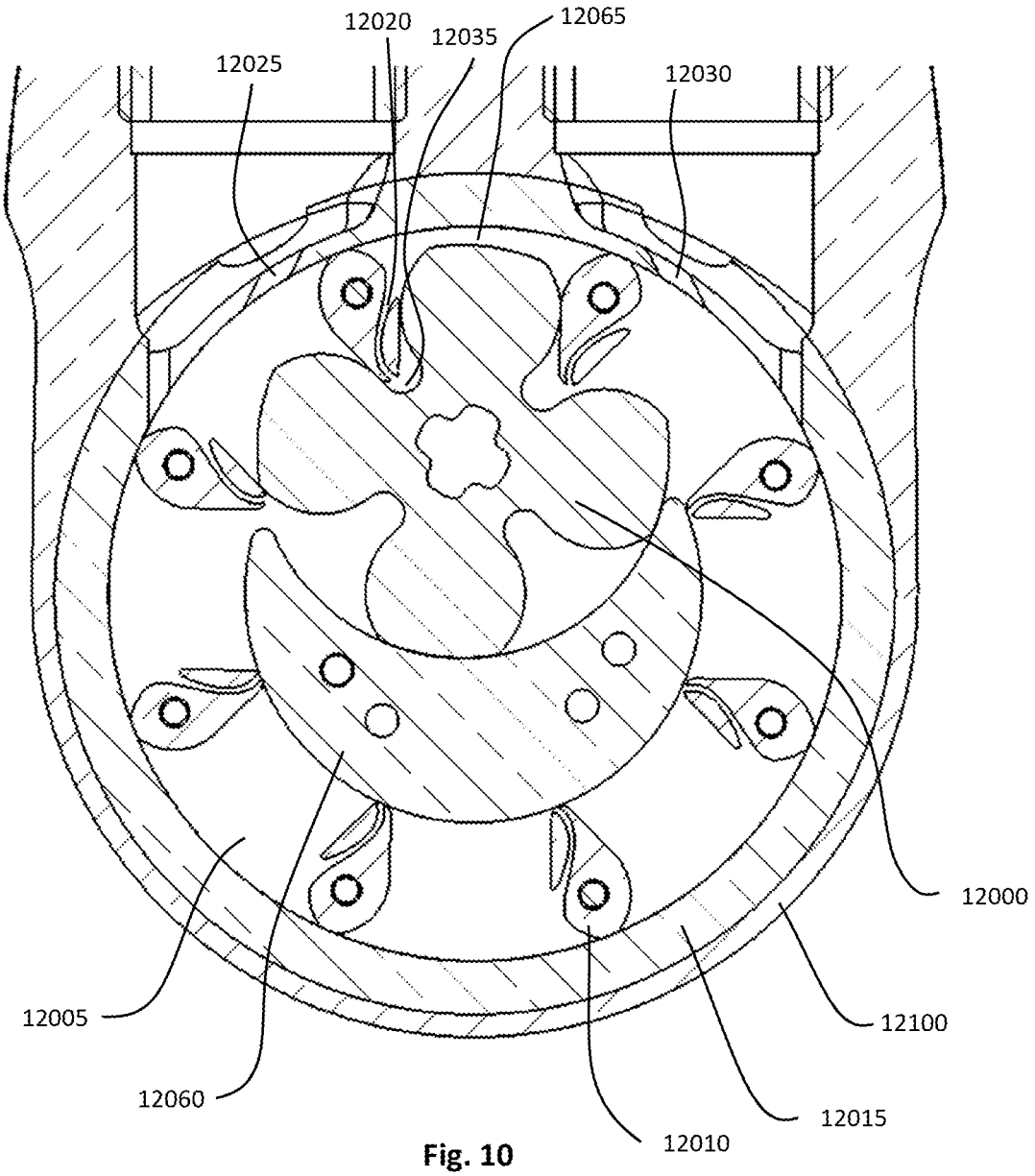
FIG. 10 is an axial cross sectional view of a non-limiting embodiment of a fluid transfer device, having fluid flow channels within the fins of an outer rotor.

In the non-limiting embodiment shown in FIG. 10, flow paths 12020 between the primary chambers 12065 and secondary chambers 12035 are located through the radial projections 12010 of the outer rotor 12005. For reference an inner rotor 12000, inlet port 12025, exhaust port 12030, and housing 12100 are shown.

Figure 11:
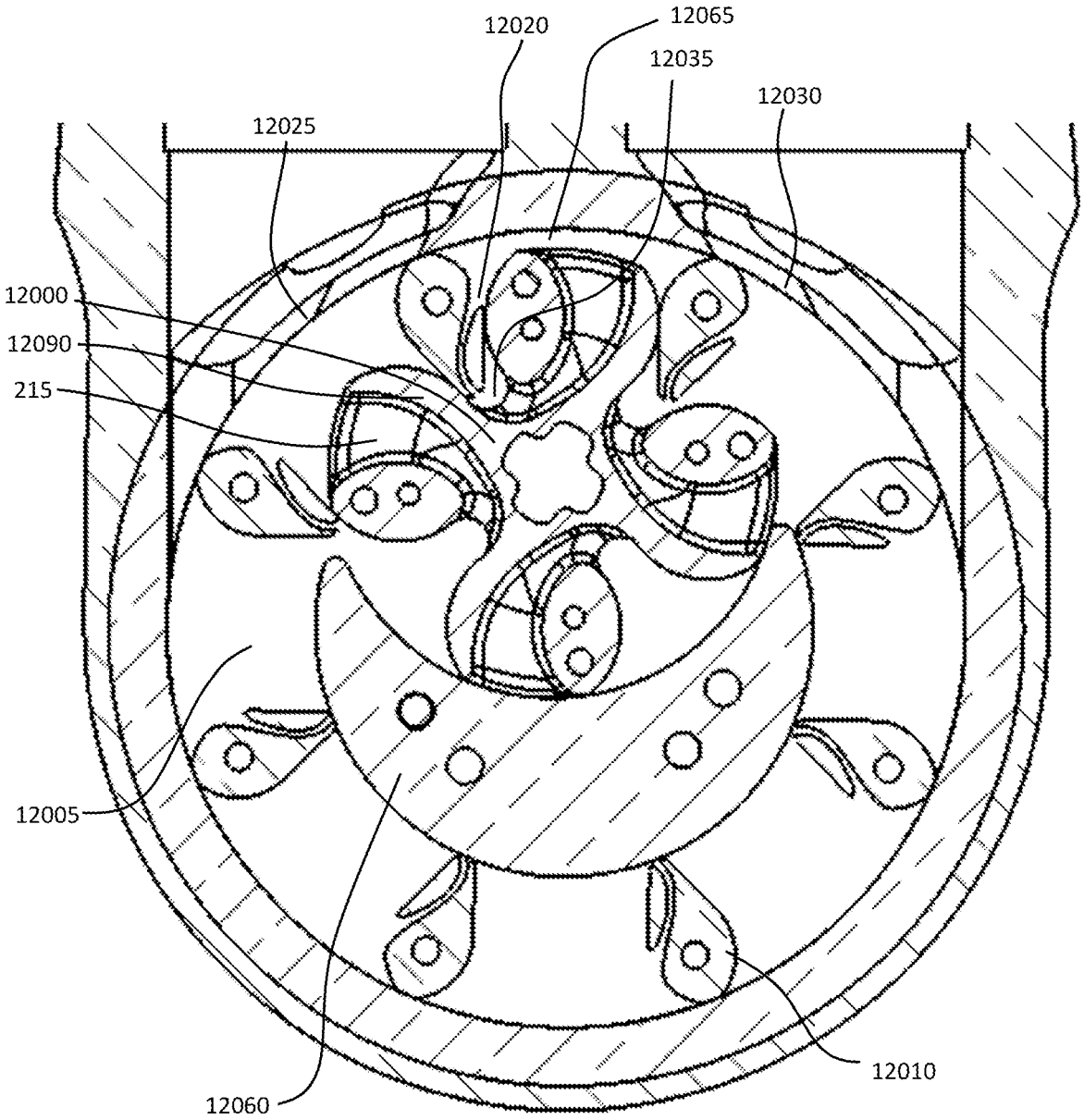
FIG. 11 is an axial cross sectional view of a non-limiting embodiment of a fluid transfer device having fluid flow channels within the lobes of an inner rotor and the fins of an outer rotor.
Figure 12:
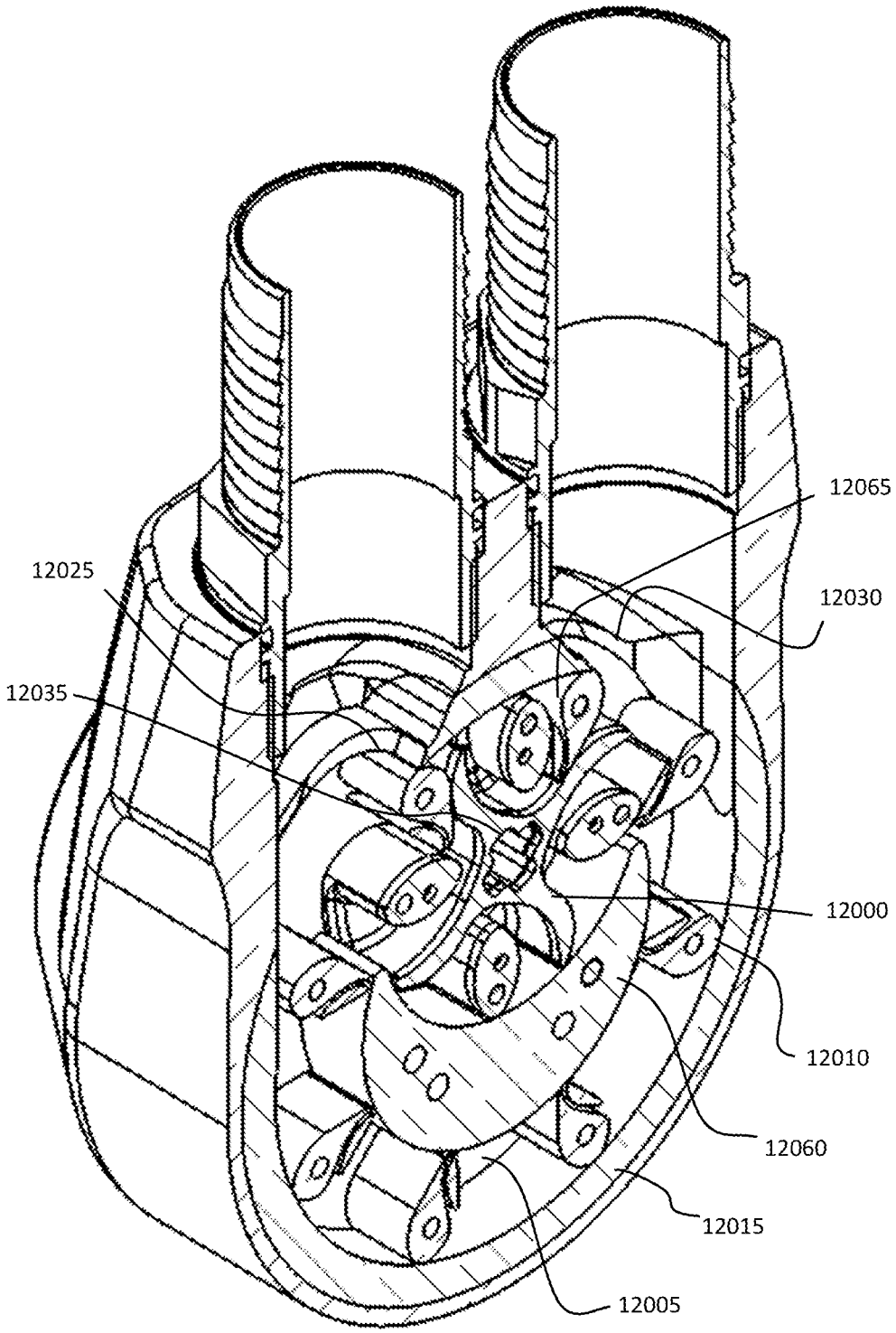
FIG. 12 is a cross sectional isometric view of the embodiment depicted in FIG. 11.
Figure 13:
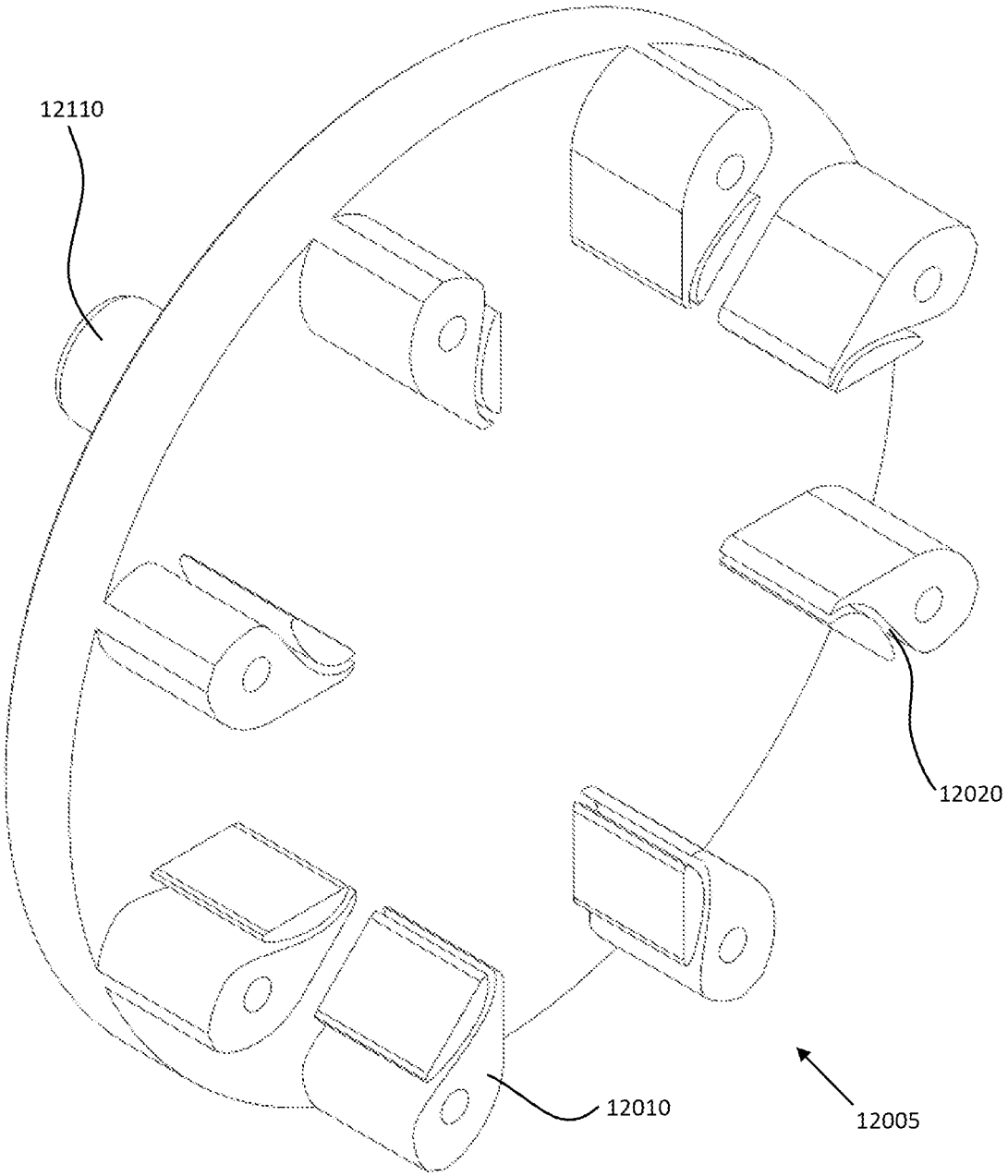
FIG. 13 is a pictorial view of an outer rotor shown in FIG. 11.

In the non-limiting embodiment shown in FIG. 11, flow paths 12020 between the primary chambers 12065 and secondary chambers 12035 are located through the radial projections 12010 of the outer rotor 12005. This flow path through the outer rotor fin is configured to allow sealing contact between the inner rotor toe and heel surface and the outer rotor fins to the outermost radial sealing position. The area outside of that is used as a flow path entry and exit which leaves a large cross section at the widest part of the tear drop shape to provide fin rigidity or a wide enough cross section for bolts to pass through the fins if desired. In addition, fluid passages 215 may be located in the radial projections 12090 of the inner rotor 12000. For reference a crescent 12060, inlet port 12025, and exhaust port 12030 are shown. An isometric view of this aforementioned embodiment shown in FIG. 11 is also shown in FIG. 12 from a different perspective. For reference the inlet port 12025, discharge port 12030, secondary chamber 12035, outer rotor 12005, housing sleeve 12015, crescent 12060, outer rotor radial projection 12010, primary chamber 12065, and inner rotor 12000 are shown. An isometric view of the outer rotor 12005 is shown in FIG. 13 showing the radial projections 12010, flow paths 12020, and outer rotor shaft 12110.

Figure 14:
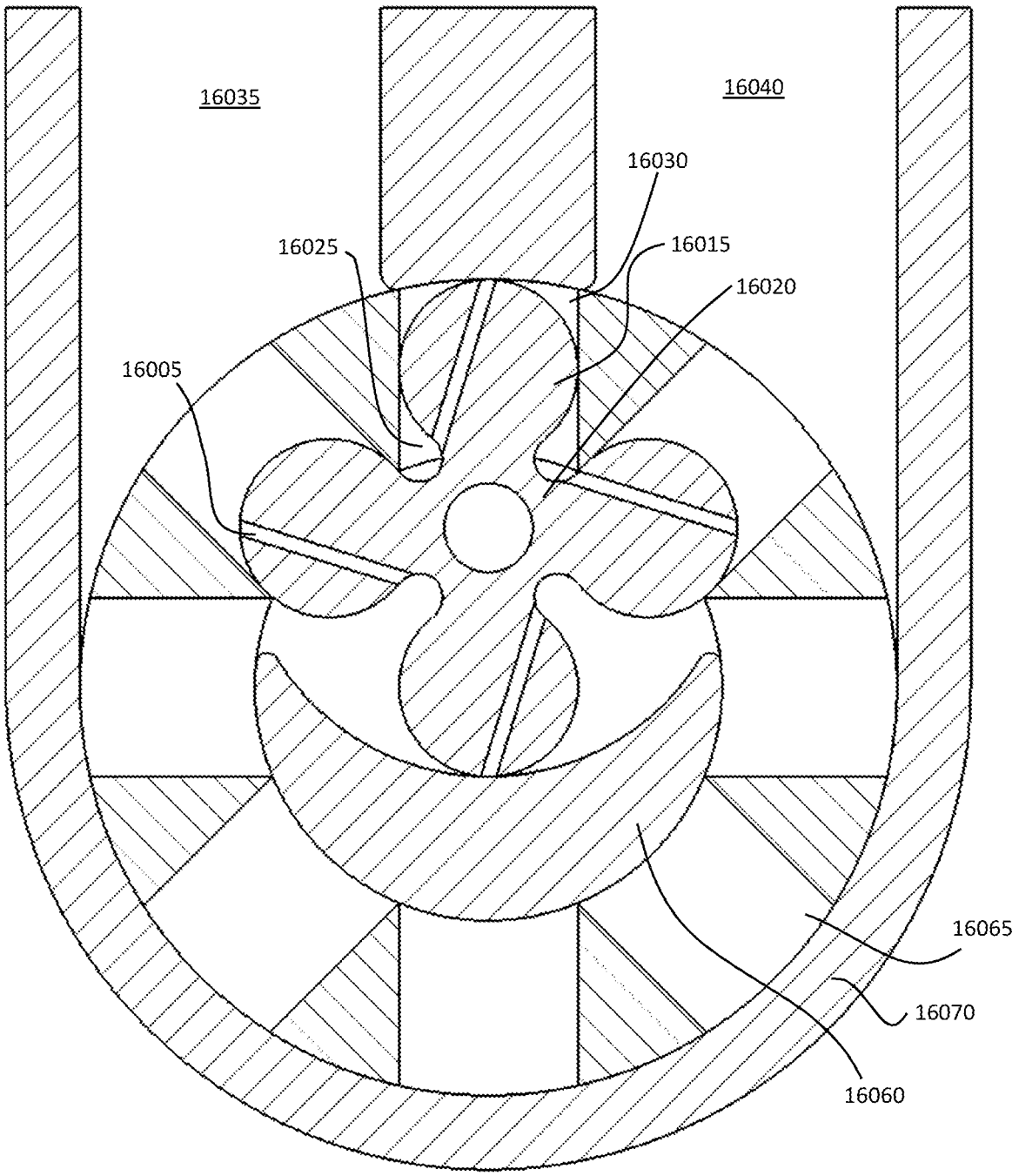
FIG. 14 is an axial cross sectional view of a non-limiting embodiment of a fluid transfer device having fluid channels located on an axial end of an inner rotor.
Figure 16:
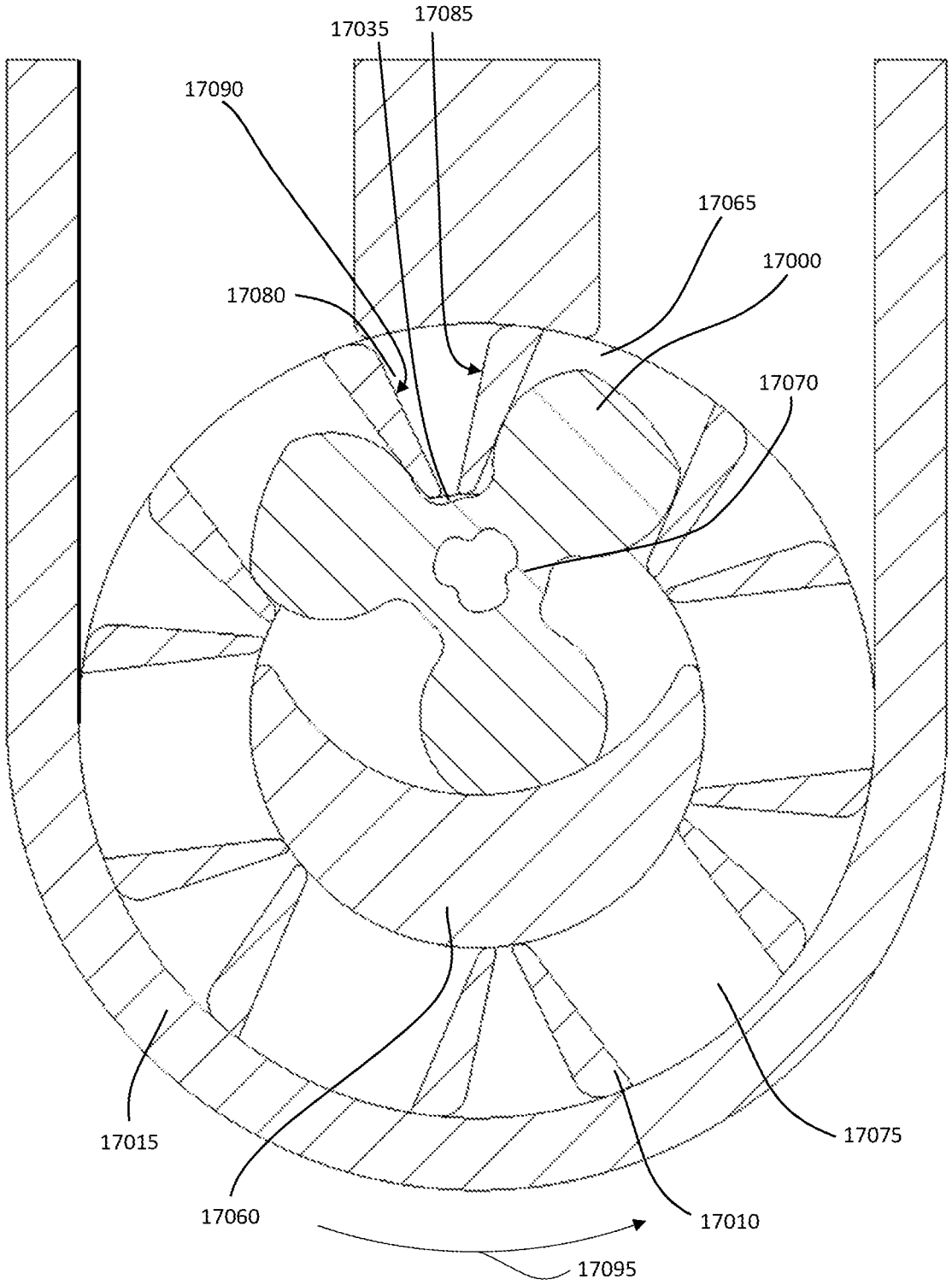
FIG. 16 is an axial cross sectional view of a non-limiting embodiment of a fluid transfer device having 3 inner rotor lobes and fluid flow channels within the fins of an outer rotor.
Figure 17:
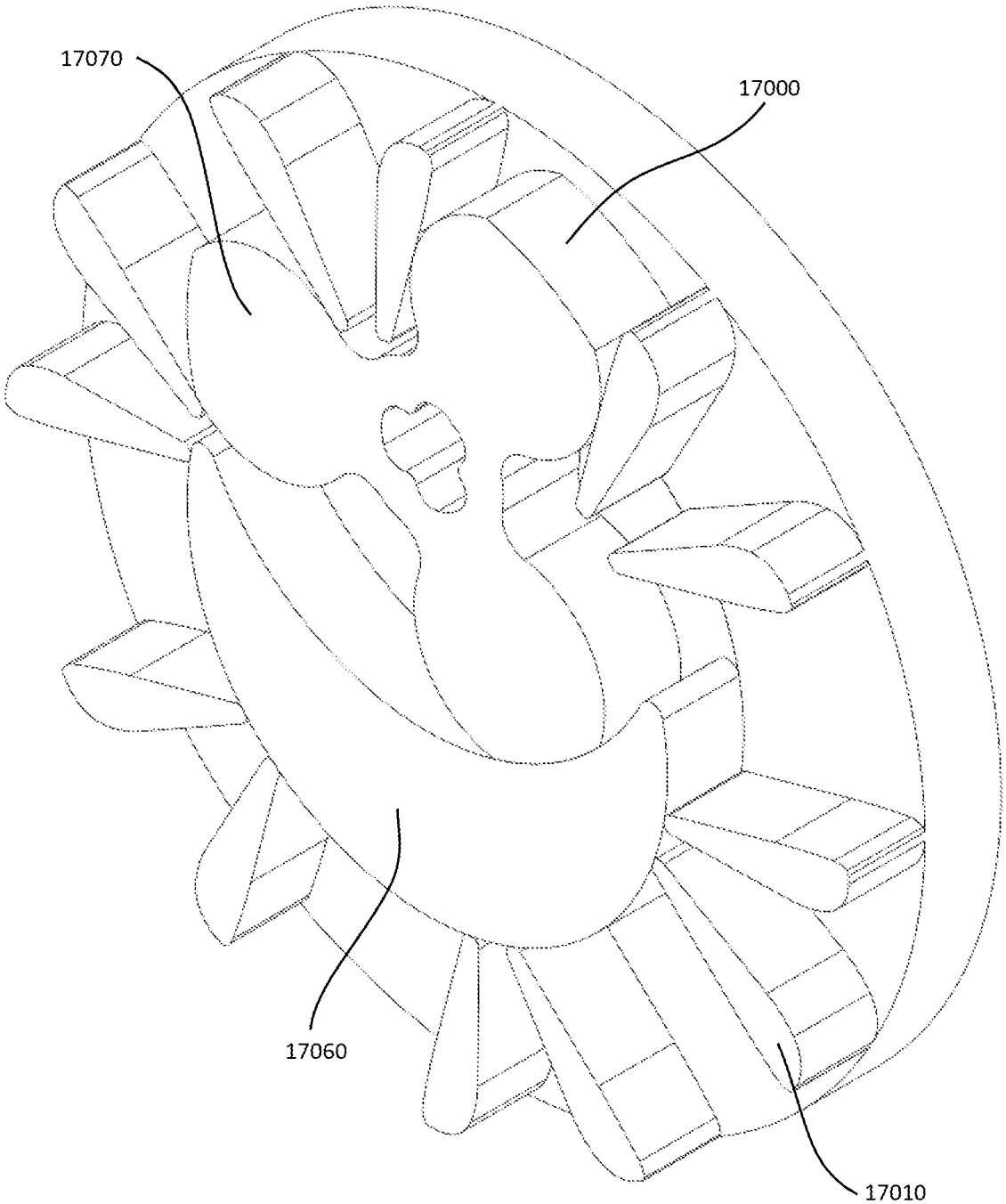
FIG. 17 is a pictorial view of an inner rotor, outer rotor and crescent seal of the embodiment depicted in FIG. 16.

A non-limiting embodiment in FIG. 14 shows a simplified version of the fluid paths 16005 located in the inner rotor 16020. The fluid paths connect the secondary chambers 16025 to the outer diameter of the outer rotor 16065, thereby connecting the secondary chambers 16025 to the primary chambers 16030 to prevent water hammer. At Top Dead Center, the position shown in FIG. 14, the ends of the inner rotor radial projections 16015 extend all the way to the outer diameter of the outer rotor 16065. This may cause sealing at the instant the machine is rotated to Top Dead Center, but would connect the secondary chamber 16025 to the primary chamber 16030 at rotational points directly clockwise or counterclockwise with respect to Top Dead Center. Another consequence of inner rotor radial projections which extend to the outer diameter of the outer rotor is decreased cross-sectional area for fluid flow into the primary chamber 16030 when the primary chamber 16030 opens to the inlet port 16030 as well as out of the primary chamber 16030 when the primary chamber 16030 closes off to the outer port 16035. A further consequence of inner rotor radial projections which extend to outer diameter of the outer rotor is decreased cross-sectional area through which fluid can flow from the secondary chamber 16025 into the primary chamber 16030 when the secondary chamber 16025 volume is decreasing, as well as out of the primary chamber 16030 into the the secondary chamber 16025 when the secondary chamber 16025 volume is increasing. The inner rotors shown for example in FIGS. 1-13 as well as FIGS. 15-17 are designed with a smaller diameter to provide a gap between the outer radius of the inner rotor radial projections and the housing at Top Dead Center to provide larger cross-sectional area into the primary chamber once the primary chamber opens to the inlet port as well as when the chamber closes off to the discharge port, thereby providing decreased flow restriction. Similarly, the gap between the housing and inner rotor lobes would likewise decrease flow restriction between the primary chambers and the secondary chambers. In this non-limiting embodiment crescent 16060 is formed as an integral part of the housing, as opposed to a separate part. However, the crescent 16060 could alternatively be a separate part from the housing with the housing and crescent assembled together. Regardless of assembly, fixed elements such as a crescent seal are regarded as part of the housing.

FIG. 18 shows a non-limiting embodiment in which a simplified inner rotor 18000 has a first array of fluid channels 18005 which span from the root between adjacent inner rotor radial projection lobes 18015 to the outer radius of the same inner rotor radial projection lobe 18015 on one axial side of inner rotor 18005 and a second array of fluid channels 18010 on the opposing axial side of inner rotor 18000 which are a mirror image of the first array of fluid channels. The axis of rotation 18020 of inner rotor 18000 is shown for reference in FIG. 18.

Tri Lobe, Smaller Crescent Results in Higher Displacement

In an embodiment shown in FIGS. 16-17, an energy transfer machine comprises an inner rotor having three lobes and the outer rotor has six fins. This is interchangeably called a tri-lobe arrangement. As compared to a four-lobe design, a three-lobe design allows for a smaller crescent outer diameter which results in a higher theoretical maximum displacement than a four-lobe device for the same outer rotor diameter.

Tri Lobe Vs. 4 Lobe Contact Ratio

Contact ratio, in this document, is defined as the average number of points of contact between the driving, leading surfaces such as leading surface 10055 in the non-limiting embodiment shown in FIG. 9 of inner rotor 10000 and the driven, trailing surfaces such as trailing surface 10040 of outer rotor 10005, also shown in FIG. 9, as they rotate. In devices of the disclosed embodiment, a ratio greater than or equal to one ensures that there is always at least one point of contact between the inner and outer rotor. It is noted that this assumes that once a driving surface stops contacting a driven surface, it does not regain contact with the driven surface until the next rotation. Similarly, contact ratio can be used to refer to the non-driving timing contact of the trailing surfaces, such as inner rotor trailing surface 10050 of the inner rotor 10000, and the leading surfaces, such as leading surface 10045 of the outer rotor 10005, which prevent the driven rotor from turning faster than it is being driven; for example, during deceleration of the inner rotor 10000. In this document, leading is used to describe a feature facing largely towards a direction of rotation and trailing is used to describe a feature facing largely away from a direction of rotation. A contact ratio which is greater than or equal to 1, for both driving and timing surfaces, is considered by the inventor to provide operation of the device without the need for external timing gears.

A four-lobe design provides a higher contact ratio than a tri-lobe arrangement. A higher contact ratio tends to provide smoother engagement and may reduce noise.

In an embodiment shown in FIG. 16 the inner rotor 17070 is the driving rotor. This may be advantageous if an electric motor is used to power the inner rotor 17075 if the optimal speed of the motor is higher than the desired operational speed of the outer rotor 17075. For example, at a given power output, an electric motor may be most efficient at 1,000 RPM. If the desired operational speed of the outer rotor is 500 RPM, the inner rotor may be the driving rotor so that the electric motor may run at its optimal speed of 1,000 RPM. Conversely, if the optimal speed of the outer rotor 17075 is similar to the optimal speed of the means of powering the pump, the outer rotor 17075 may be the driving rotor. The inventor contemplates that other methods may be used as the means of driving the disclosed device, such as but not limited to a hydraulic motor, an internal combustion engine, connected to the input of the disclosed device via pumps, gears, or directly coupled, or a combination of methods.

Secondary Chambers in Three Lobe

In the non-limiting three-lobe designs shown in FIGS. 15-17 secondary chambers 17035 form at the area between the root of the radial projections 17000 on the inner rotor 17000 and the outer rotor radial projections 17010.

In the non-limiting embodiment shown in FIGS. 16-17, the outer rotor 17010 radial projections feature a flow path 17080 which leads from the secondary chambers 17035 to the outer diameter of the outer rotor. This prevents water hammer from occurring but does not introduce a leakage path from the inlet side of the pump to the exhaust side of the pump at any point during the rotation of the two rotors. FIG. 17 shows an isometric view of the inner rotor 17070, crescent 17060, housing 17015, and outer rotor radial projections 17010. For reference the direction of rotation is shown by arrow 17095.

In the non-limiting example shown in FIG. 16, flow paths 17080 connecting secondary chambers 17035 to the outer diameter of the outer rotor are located between two adjacent outer rotor surfaces, which come into contact with the inner rotor lobes, for example between outer rotor radial projection inner trailing edge 17090 and outer rotor radial projection inner leading edge 17085, and lead to the outer diameter of the outer rotor 17075.

Drawings are semi-schematic illustrations and may lack certain elements such as bearings for simplicity.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The invention claimed is:

1. A positive displacement fluid transfer device comprising:

a housing defining an inlet flow channel and an outlet flow channel;

a first rotor mounted for rotation within the housing about a first rotor axis and having first rotor teeth, and defining at least in part first rotor chambers between the first rotor teeth, each of the first rotor chambers being defined at least in part by first rotor non-axial bearing surfaces of two first rotor teeth of the first rotor teeth;

a second rotor mounted for rotation within the housing about a second rotor axis parallel to the first rotor axis and having second rotor teeth, and defining at least in part second rotor chambers between the second rotor teeth, each of the second rotor chambers being defined at least in part by second rotor non-axial bearing surfaces of two second teeth of the second rotor teeth;

the first rotor teeth and the second rotor teeth being configured to mesh together at a meshing portion of the fluid transfer device, the first rotor non-axial bearing surfaces contacting the second rotor non-axial bearing surfaces as the first rotor teeth mesh with the second rotor teeth;

the first rotor teeth and the second rotor teeth entering into the meshing at an outlet portion of the device, the meshing of the first rotor teeth and the second rotor teeth reducing the collective volume of the first rotor chambers and the second rotor chambers in the outlet portion of the device, at least the first rotor chambers being open to the outlet flow channel in the outlet portion of the device;

the first rotor teeth and the second rotor teeth unmeshing at an inlet portion of the device, the unmeshing of the first rotor teeth and the second rotor teeth increasing the collective volume of the first rotor chambers and the second rotor chambers in the inlet portion of the device, at least the first rotor chambers or at least the second rotor chambers being open to the inlet flow channel in the inlet portion of the device, at least one of the first rotor and the second rotor defining flow channels, the flow channels being internal to the first rotor relative to the first rotor non-axial bearing surfaces or internal to the second rotor relative to the second rotor non-axial bearing surfaces, and the flow channels being arranged to connect the first rotor chambers with the second rotor chambers at least in part of the inlet portion, the meshing portion or the outlet portion of the device.

2. The positive displacement fluid transfer device of claim 1 in which the first rotor is an outer rotor and the second rotor is an inner rotor, the teeth of the outer rotor (outer rotor teeth) meshing with the teeth of the inner rotor (inner rotor teeth) as internal gear teeth.

3. The positive displacement fluid transfer device of claim 2 further comprising a crescent seal between the inner rotor and the outer rotor.

4. The positive displacement fluid transfer device of claim 3 in which the crescent seal seals against the outer rotor teeth for positive displacement of fluid around the crescent seal in the first rotor chambers.

5. The positive displacement fluid transfer device of claim 3 which the crescent seal seals against the inner rotor teeth for positive displacement of fluid around the crescent seal in the second rotor chambers.

6. The positive displacement fluid transfer device of claim 3 in which the rotation of the outer rotor defines a leading direction and a trailing direction, and at least in cross section in a plane perpendicular to the outer rotor axis, the outer rotor teeth are shaped as fins, the first rotor non-axial bearing surfaces comprising generally straight leading fin surfaces and generally straight trailing fin surfaces, and the inner rotor teeth are shaped as lobes, the second rotor non-axial bearing surfaces comprising rounded leading lobe surfaces and rounded trailing lobe surfaces, the leading lobe surfaces being arranged to contact the trailing fin surfaces and the trailing lobe surfaces being arranged to contact the leading fin surfaces.

7. The positive displacement fluid transfer device of claim 6 in which the outer rotor fins number twice the inner rotor lobes.

8. The positive displacement fluid transfer device of claim 7 in which, at least in cross section in the plane, the leading and trailing fin surfaces are straight and the leading and trailing lobe surfaces are circular arcs.

9. The positive displacement device of claim 8 in which a first fin of the outer rotor fins has a leading first fin surface of the leading fin surfaces parallel to and displaced in the trailing direction from a first radial line through the outer rotor axis by a first displacement amount, an opposite fin of the outer rotor fins being rotationally symmetric with the first fin of the outer rotor fins, and a first lobe of the inner rotor lobes has a trailing first lobe surface of the trailing lobe surfaces formed in a trailing arc shape, the trailing arc shape having a trailing arc radius substantially equal to, or equal to less a first clearance value, the first displacement amount.

10. The positive displacement device of claim 8 in which a second fin of the outer rotor fins has a trailing second fin surface of the trailing fin surfaces parallel to and displaced in the leading direction from a second radial line through the outer rotor axis by a second displacement amount, a second opposite fin of the outer rotor fins being rotationally symmetric with the second fin of the outer rotor fins, and a second lobe of the inner rotor lobes has a leading second lobe surface of the leading lobe surfaces formed in a leading arc shape, the leading arc shape having a leading arc radius substantially equal to, or equal to less a second clearance value, the second displacement amount.

11. The positive displacement device of claim 10 in which the first displacement amount is equal to the second displacement amount.

12. The positive displacement device of claim 10 in which the first lobe is the second lobe, the trailing arc shape is concentric with the leading arc shape, and the leading first fin surface is parallel to the trailing second fin surface.

13. The positive displacement device of claim 1 in which the outer rotor fins are rotationally symmetric about the outer rotor and the inner rotor lobes are rotationally symmetric about the inner rotor.

14. The positive displacement fluid transfer device of claim 1 in which the first rotor teeth and the second rotor teeth mesh as external gear teeth.

15. The positive displacement fluid transfer device of claim 1 in which the flow channels are within the first rotor teeth.

16. The positive displacement fluid transfer device of claim 1 in which the flow channels are within the second rotor teeth.

17. The positive displacement fluid transfer device of claim 1 in which the first rotor defines first rotor flow channels of the flow channels and the second rotor defines second rotor flow channels of the flow channels.

18. The positive displacement fluid transfer device of claim 17 in which the first rotor teeth and the second rotor teeth mesh as external gear teeth and the first rotor flow channels are within every second of the first rotor teeth and the second rotor flow channels of the second rotor within every second of the second rotor teeth.

19. The positive displacement fluid transfer device of claim 1 to direct fluid flow throughout the device substantially perpendicular to the first rotor axis.

20. The positive displacement fluid transfer device of claim 1 configured to operate as a pump, the inner rotor being connected to a mechanical energy source to drive the pump.

21. The positive displacement fluid transfer device of claim 1 configured to operate as a pump, the outer rotor being connected to a mechanical energy source to drive the pump.

22. The positive displacement fluid transfer device of claim 1 configured to operate as a hydraulic motor, fluid pressure driving the inner rotor, the inner rotor being connected to a mechanical energy receiver.

23. The positive displacement fluid transfer device of claim 1 configured to operate as a hydraulic motor, fluid pressure driving the outer rotor, the outer rotor being connected to a mechanical energy receiver.

* * * * *